US011856362B2

(12) United States Patent
Hagio

(10) Patent No.: US 11,856,362 B2
(45) Date of Patent: Dec. 26, 2023

(54) LOUDSPEAKER APPARATUS, LOUDSPEAKER, AND STRUCTURE

(71) Applicant: SONY GROUP CORPORATION, Tokyo (JP)

(72) Inventor: Junji Hagio, Tokyo (JP)

(73) Assignee: SONY GROUP CORPORATION, Tokyo (JP)

( * ) Notice: Subject to any disclaimer, the term of this patent is extended or adjusted under 35 U.S.C. 154(b) by 121 days.

(21) Appl. No.: 17/607,070

(22) PCT Filed: Mar. 25, 2020

(86) PCT No.: PCT/JP2020/013249
§ 371 (c)(1),
(2) Date: Oct. 28, 2021

(87) PCT Pub. No.: WO2020/225993
PCT Pub. Date: Nov. 12, 2020

(65) Prior Publication Data

US 2022/0240007 A1 Jul. 28, 2022

(30) Foreign Application Priority Data

May 9, 2019 (JP) ..... 2019-089142

(51) Int. Cl.
*H04R 1/34* (2006.01)
*H04R 1/02* (2006.01)
*G10K 11/20* (2006.01)

(52) U.S. Cl.
CPC ..... *H04R 1/345* (2013.01); *G10K 11/20* (2013.01); *H04R 1/025* (2013.01); *H04R 2499/15* (2013.01)

(58) Field of Classification Search
CPC .... H04R 1/345; H04R 1/025; H04R 2499/15; G10K 11/20

(Continued)

(56) References Cited

U.S. PATENT DOCUMENTS

2014/0003645 A1* 1/2014 Silver ..... H04R 1/2803 381/351
2015/0098586 A1* 4/2015 Tanabe ..... H04R 1/2849 381/86

(Continued)

FOREIGN PATENT DOCUMENTS

JP 52-136574 U 10/1977
JP 04-222180 A 8/1992

(Continued)

OTHER PUBLICATIONS

International Search Report and Written Opinion of PCT Application No. PCT/JP2020/013249, dated Jun. 16, 2020, 08 pages of ISRWO.

*Primary Examiner* — Sean H Nguyen
(74) *Attorney, Agent, or Firm* — CHIP LAW GROUP

(57) ABSTRACT

A loudspeaker apparatus according to an embodiment of the present technology includes a loudspeaker and a structure. The loudspeaker outputs sounds. The structure is configured with respect to an object that is disposed on a sound output side of the loudspeaker and forms, between the object and the loudspeaker, a gap space communicating with an external space, and includes a connecting portion and one or more plate-like members. The connecting portion is connected to the loudspeaker. The one or more plate-like members have a plate shape, are disposed in the gap space, extend toward an opening portion of the gap space, and guide sounds output from the loudspeaker toward the external space, the opening portion being located on a side communicating with the external space.

20 Claims, 15 Drawing Sheets

(58) Field of Classification Search
USPC ..... 381/160
See application file for complete search history.

(56) References Cited

U.S. PATENT DOCUMENTS

| | | | | |
|---|---|---|---|---|
| 2018/0063635 | A1* | 3/2018 | Colich | H05B 45/14 |
| 2018/0255394 | A1* | 9/2018 | Colich | H05B 45/14 |
| 2019/0028801 | A1* | 1/2019 | Chen | G10K 11/025 |
| 2019/0037303 | A1* | 1/2019 | Peace, Jr. | H04R 1/24 |

FOREIGN PATENT DOCUMENTS

| | | | |
|---|---|---|---|
| JP | 2006-319723 | A | 11/2006 |
| JP | 6506464 | B1 | 4/2019 |

* cited by examiner

LOUDSPEAKER APPARATUS, LOUDSPEAKER, AND STRUCTURE

CROSS REFERENCE TO RELATED APPLICATIONS

This application is a U.S. National Phase of International Patent Application No. PCT/JP2020/013249 filed on Mar. 25, 2020, which claims priority benefit of Japanese Patent Application No. JP 2019-089142 filed in the Japan Patent Office on May 9, 2019. Each of the above-referenced applications is hereby incorporated herein by reference in its entirety.

TECHNICAL FIELD

The present technology relates to a loudspeaker apparatus, a loudspeaker, and a structure.

BACKGROUND ART

In an electronic apparatus described in Patent Literature 1, loudspeakers are disposed on both left and right sides below a liquid-crystal display unit. Sounds output from the loudspeakers are output to the front side via slits that function as passing holes (paragraphs [0015] to [0025] in the specification, FIGS. 1 to 3, and the like of Patent Literature 1).

In a television (television set) described in Patent Literature 2, loudspeakers are disposed on left and right side surfaces of a cathode-ray tube. A reflector that reflects sounds from the loudspeakers to the front side of the television screen is disposed in front of the loudspeaker. Moreover, an acoustic lens capable of controlling the directivity of sounds reflected by the reflector is disposed at a position on approximately the same plane as the television image. Accordingly, sound images can be made clear and high-quality sounds matching pictures can be output without increasing the size of the television cabinet (paragraphs [0009] to [0021] in the specification, FIGS. 1 and 2, and the like of Patent Literature 2).

CITATION LIST

Patent Literature

Patent Literature 1: Japanese Patent Application Laid-open No. 2006-319723

Patent Literature 2: Japanese Patent Application Laid-open No. HEI 4-222180

DISCLOSURE OF INVENTION

Technical Problem

In recent years, flat-panel display televisions and the like have been mainstream and also screens have increased in size. It is desirable to provide a technology by which high-quality and sufficient sound pressure output matching powerful pictures can be achieved without degrading the design of such televisions and the like.

In view of the above-mentioned circumstances, it is an object of the present technology to provide a loudspeaker apparatus, a loudspeaker, and a structure by which high-quality and sufficient sound pressure output can be achieved without degrading the design.

Solution to Problem

In order to accomplish the above-mentioned object, a loudspeaker apparatus according to an embodiment of the present technology includes a loudspeaker and a structure.

The loudspeaker outputs sounds.

The structure is configured with respect to an object that is disposed on a sound output side of the loudspeaker and forms, between the object and the loudspeaker, a gap space communicating with an external space, and includes a connecting portion and one or more plate-like members.

The connecting portion is connected to the loudspeaker.

The one or more plate-like members have a plate shape, are disposed in the gap space, extend toward an opening portion of the gap space, and guide sounds output from the loudspeaker toward the external space, the opening portion being located on a side communicating with the external space.

This loudspeaker apparatus includes the structure configured with respect to the object that is disposed on the sound output side of the loudspeaker. The structure includes the one or more plate-like members that are disposed in the gap space between the object and the loudspeaker and guide sounds output from the loudspeaker toward the external space. Accordingly, it is possible to prevent the sound quality from being affected while employing the configuration to cover and hide the sound output side of the loudspeaker. As a result, a high-quality and sufficient sound pressure can be output without degrading the design.

The one or more plate-like members may be a plurality of plate-like members and a divided space may be formed between the plate-like members adjacent to each other.

The plurality of plate-like members may be configured inside the gap space.

At least one of the plurality of plate-like members may have an end portion on a side of the opening portion, the end portion protruding outward from the opening portion.

The plurality of plate-like members may be configured to be parallel to each other.

The plurality of plate-like members may be configured such that the divided space is opened in a direction orthogonal to an extending direction toward the opening portion.

The plurality of plate-like members may include a first member that is disposed at a position furthest from the loudspeaker in a sound output direction. In this case, the first member may have an end portion on a side of the loudspeaker, the end portion being coupled to the connecting portion.

The loudspeaker may include a diaphragm. In this case, the first member may be configured to cover and hide the diaphragm in a region from a position of the connecting portion to an end portion of the first member as viewed from the sound output side of the loudspeaker, the end portion being located on a side of the opening portion.

The plurality of plate-like members may include the first member and one or more second members other than the first member. In this case, the one or more second members may be disposed such that a clearance is formed between an end portion of each second member on the side of the loudspeaker and the connecting portion.

The plurality of plate-like members may be connected to each other through a reinforcing rib.

The loudspeaker may include a diaphragm and a frame disposed around the diaphragm. In this case, the connecting portion may be connected to the frame.

The connecting portion may be held in contact with a portion of the frame, the portion being located on a side opposite to a side of the opening portion of the gap space.

The one or more plate-like members may be configured integrally with the connecting portion.

The loudspeaker may include a diaphragm. In this case, the object may be disposed to cover and hide a part of the diaphragm as the object and the loudspeaker are viewed from the sound output side of the loudspeaker. Moreover, the one or more plate-like members may guide sounds output from the loudspeaker toward a visible part of the diaphragm.

The loudspeaker may include a diaphragm. In this case, the opening portion of the gap space may be configured at a position of an end portion of the object, which is located on a side of the visible part of the diaphragm, as the object and the loudspeaker are viewed from the sound output side of the loudspeaker.

The loudspeaker apparatus may be incorporated in an electronic apparatus. In this case, the sound output side of the loudspeaker may be made to face a front side of the electronic apparatus. Moreover, the object may be disposed on the sound output side of the loudspeaker in a state in which the loudspeaker apparatus is incorporated in the electronic apparatus.

The loudspeaker apparatus may further include the object.

The object may be a part of the electronic apparatus.

A loudspeaker according to an embodiment of the present technology includes a loudspeaker portion and a structure.

The loudspeaker portion outputs sounds.

The structure configured with respect to an object that is disposed on a sound output side of the loudspeaker portion and forms, between the object and the loudspeaker portion, a gap space communicating with an external space, and includes a connecting portion and one or more plate-like members.

The connecting portion is connected to the loudspeaker portion.

The one or more plate-like members have a plate shape, are disposed in the gap space, extend toward an opening portion of the gap space, and guide sounds output from the loudspeaker toward the external space, the opening portion being located on a side communicating with the external space.

A structure according to an embodiment of the present technology is a structure configured with respect to an object that is disposed on a sound output side of a loudspeaker and forms, between the object and the loudspeaker, a gap space communicating with an external space, and includes the connecting portion and the one or more plate-like members.

MODE(S) FOR CARRYING OUT THE INVENTION

Hereinafter, embodiments according to the present technology will be described with reference to the drawings.

[Configuration of Electronic Apparatus]

Figure 1:
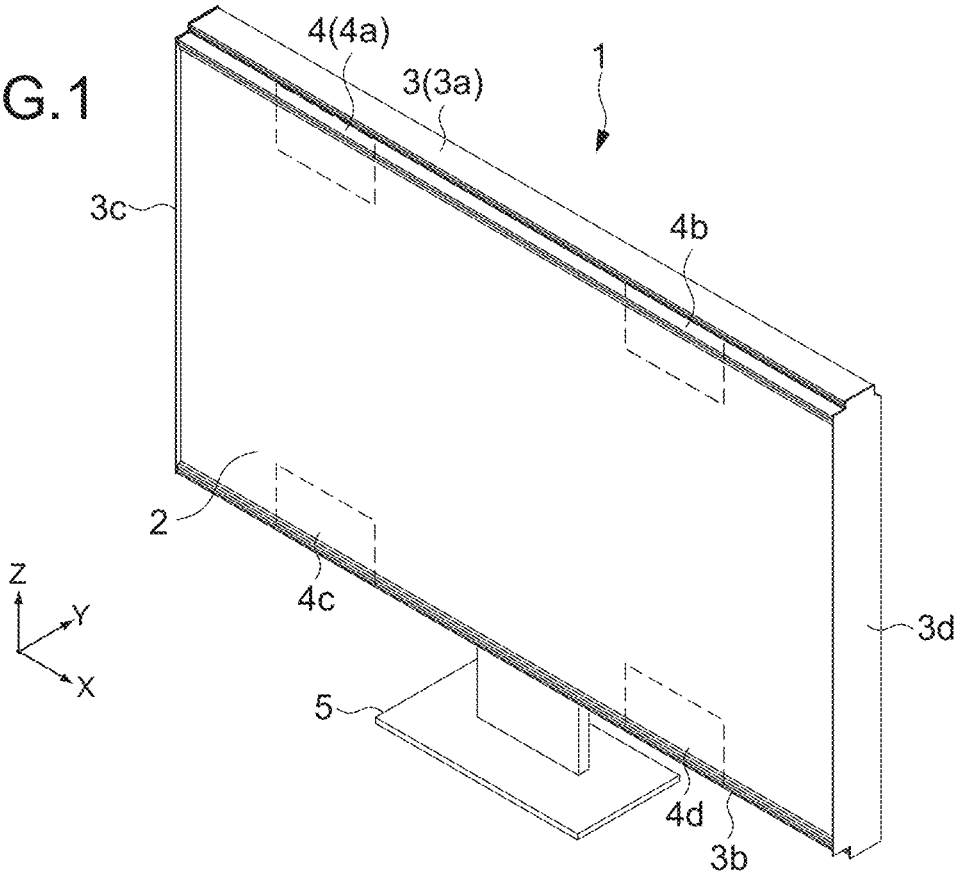
FIG. 1 A diagram schematically showing an outer appearance example of a television according to an embodiment of the present technology.

FIG. 1 is a diagram schematically showing an outer appearance example of a television (television set) according to an embodiment of the present technology.

Hereinafter, descriptions will be given assuming that as a television 1 is viewed from the front side, a left-and-right direction is defined as an X direction, a depth direction is defined as a Y direction, and a height direction is defined as a Z direction.

Moreover, as for each portion or unit, the wordings "right side", "left side", "deep side", "front side", "upper side", and "lower side", which are based on each of the XYZ directions, will be used in some cases. Moreover, the wordings "front side" and "back side" will be used in some cases in the depth direction (the Y direction).

The television 1 generally has a plate-like shape and is configured as a so-called flat-panel display television. The television 1 includes a display 2, a casing portion 3, loudspeaker boxes 4, and a stand 5.

The display 2 is disposed in the substantially entire area of a front surface of the television 1 and displays content such as a television program. In addition, as the display 2 is connected to an external content reproduction apparatus or the like, the display 2 can also display content output from the content reproduction apparatus or the like.

In this embodiment, a liquid-crystal display is used as the display 2. The present technology is not limited thereto, and an arbitrary display device such as a display using electroluminescence (EL) or the like may be employed as the display 2.

The casing portion 3 holds the display 2 on the front side of the television 1. The casing portion 3 has an upper holding portion 3*a*, a lower holding portion 3*b*, a left holding portion 3*c*, and a right holding portion 3*d*, which are disposed in the upper and lower, left and right portions of the display 2. Moreover, the casing portion 3 has a rear cover 3*e* (see FIG. 3) that is disposed on the back side of the display 2.

The casing portion 3 is constituted by the upper holding portion 3*a*, the lower holding portion 3*b*, the left holding portion 3*c*, the right holding portion 3*d*, and the rear cover 3*e*. An internal space S1 (see FIG. 3) is formed inside the casing portion 3. A display unit 13 (see FIG. 3) including the display 2, various control boards (see FIG. 2), the loudspeaker boxes 4, and the like are disposed in this internal space S1.

The upper holding portion 3*a*, the lower holding portion 3*b*, the left holding portion 3*c*, and the right holding portion 3*d* that hold the periphery of the display 2 are also called bezel.

The casing portion 3 is constituted by a metal material such as aluminum, for example.

The loudspeaker boxes 4 are disposed in the internal space S1 of the television 1. In this embodiment, four loudspeaker boxes 4*a* to 4*d* are disposed as shown in FIG. 1.

As the television 1 is viewed from the front side, the loudspeaker box 4*a* is disposed at the upper left position and the loudspeaker box 4*b* is disposed at the upper right position. Also, the loudspeaker box 4*c* is disposed at the lower left position and the loudspeaker box 4*b* is disposed at the lower right position.

The loudspeaker box 4*a* and the loudspeaker box 4*b* are disposed at positions to be left-right symmetric to each other with respect to a center line (not shown) extending from the center position of the display 2 in the upper-and-lower direction. The loudspeaker box 4*c* and the loudspeaker box 4*d* are also disposed at positions to be left-right symmetric to each other with respect to the same center line.

Moreover, the loudspeaker box 4*a* and the loudspeaker box 4*c* are disposed at the same position in the left-and-right direction (the X direction). Moreover, the loudspeaker box 4*b* and the loudspeaker box 4*d* are also disposed at the same position in the left-and-right direction. Therefore, the four loudspeaker boxes 4*a* to 4*d* are disposed at positions to be symmetric to each other with respect to the center position of the display 2.

The number, arrangement, and the like of the loudspeaker boxes 4 are not limited, and may be arbitrarily set. For example, as the television 1 is viewed from the front side, an arbitrary number of loudspeaker boxes 4 may be disposed only on the upper side. In contrast, an arbitrary number of loudspeaker boxes 4 may be disposed only on the lower side. Alternatively, an arbitrary number of loudspeaker boxes 4 may be disposed on the left side or the right side. As a matter of course, the loudspeaker boxes 4*a* to 4*d* shown in FIG. 1 may be disposed to be deviated from each other in the left-and-right direction or the upper-and-lower direction.

In this embodiment, an example in which the four loudspeaker boxes 4 having the same configuration are used will be shown.

Figure 6:
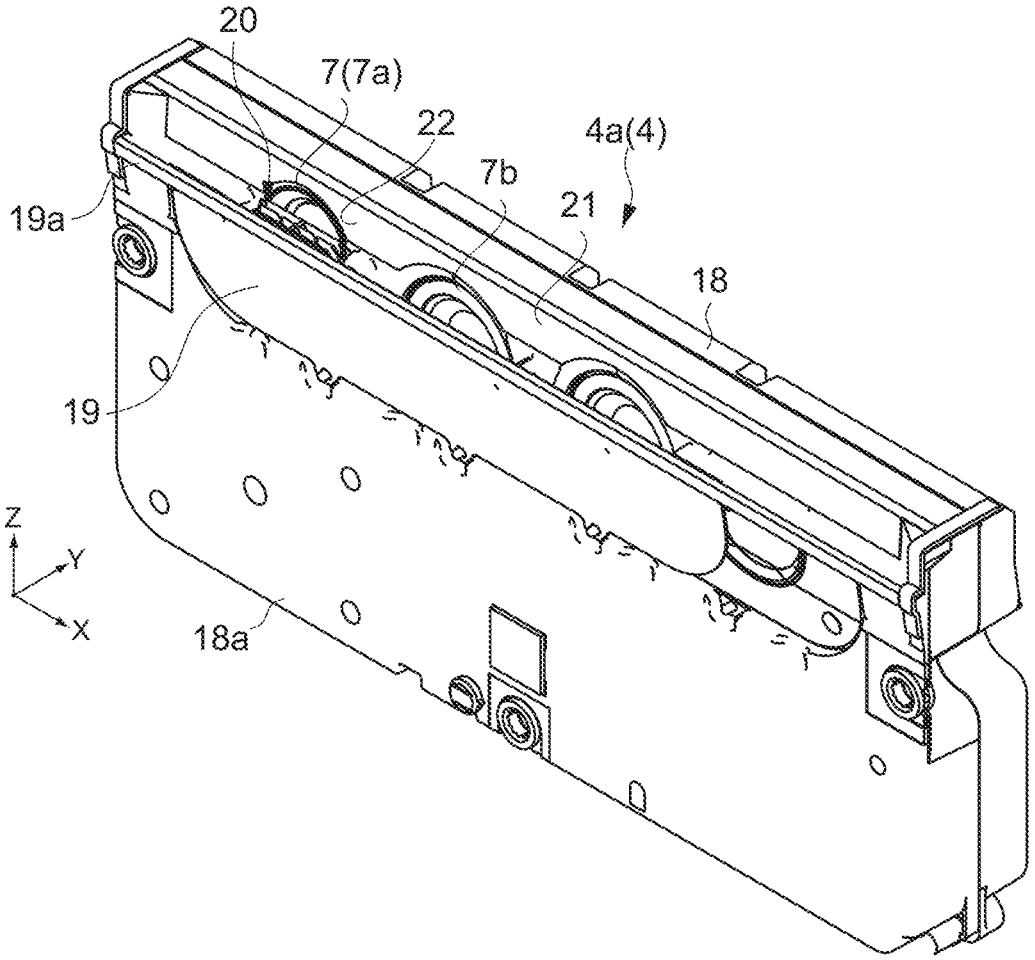
FIG. 6 A perspective view schematically showing an outer appearance example of the loudspeaker box.

The loudspeaker boxes 4 include a plurality of loudspeakers (see FIG. 6). The loudspeaker boxes 4 are disposed in the internal space S1 of the television 1 such that the loudspeakers 7 are made to face the front side of the television 1. That is, a sound output side of the loudspeakers 7 of the loudspeaker boxes 4 is made to face the front side of the television 1.

In the present disclosure, "being made to face the front side" is not limited to a case where a sound output direction of the loudspeakers 7 is completely identical to the front direction (the Y direction) pf the television 1. It also includes a state in which the output side of the loudspeakers 7 is made to face substantially the front side of the television 1. For example, the concept of "being made to face the front side" also includes a case where the angle of intersection of the sound output direction of the loudspeakers with the front direction (the Y direction) of the television 1 is within a predetermined margin of error.

The predetermined margin of error can be defined to be a range of 10 degrees or less, for example.

The stand 5 is connected to the lower holding portion 3*b* of the casing portion 3 and supports the display 2 and the casing portion 3. The specific configuration of the stand 5 is not limited, and may be arbitrarily designed. Moreover, a configuration without the stand 5 is also possible.

For example, the television 1 may be installed on a wall or the like.

Figure 2:
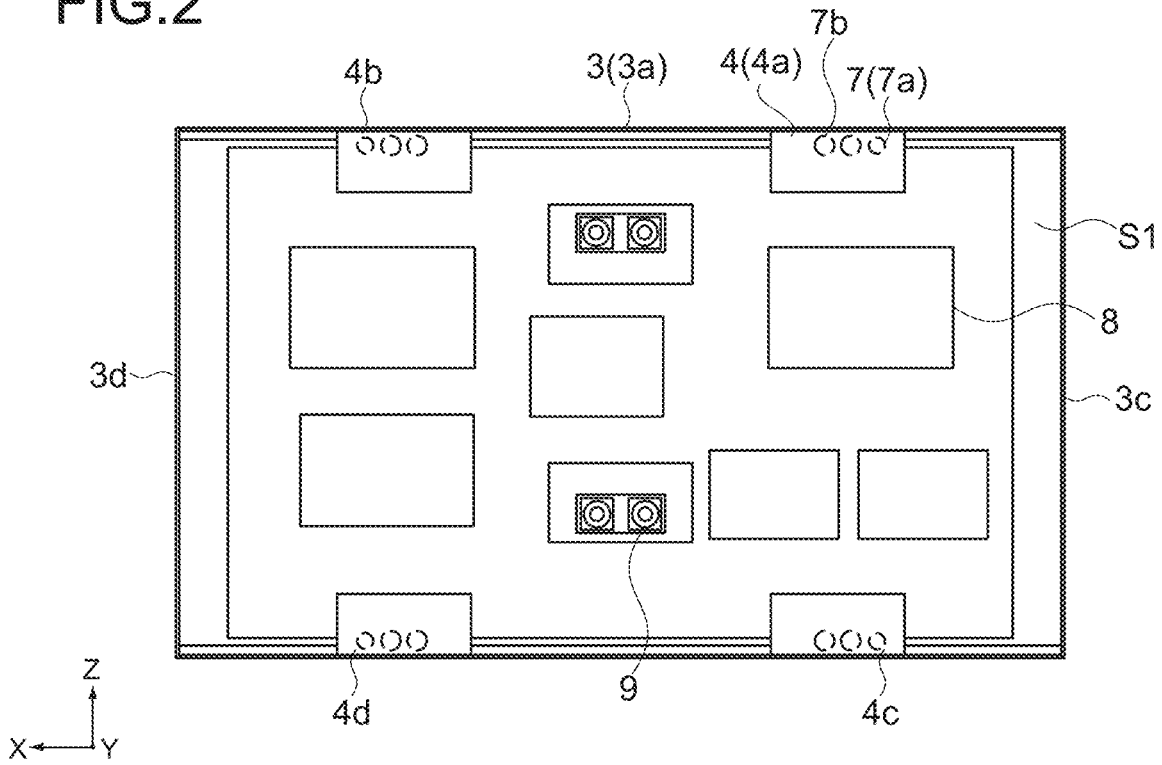
FIG. 2 A schematic diagram of a state of a television from which a rear cover on the back side is removed.

FIG. 2 is a schematic diagram showing the back side of the television 1 and is a diagram of a state in which the rear cover 3*e* is removed. As described above, the four loudspeaker boxes 4 are disposed in the internal space S1. Moreover, the loudspeaker boxes 4 include the plurality of loudspeakers 7.

The loudspeakers 7 are dynamic speaker units and have a diaphragm, a frame, a voice coil, and the like.

In this embodiment, one loudspeaker (hereinafter, referred to as a tweeter) 7*a* for high sounds and two loudspeakers 7*b* for middle sounds are installed in the loudspeaker box 4.

The tweeter 7*a* and the loudspeakers 7*b* for middle sounds are disposed such that their sound output directions are the same. The sound output side of the tweeter 7*a* and the loudspeakers 7*b* for middle sounds is made to face the front side of the television 1.

Moreover, various control boards 8 are disposed inside the internal space S1 of the television 1 so as to face the back side.

Moreover, loudspeakers 9 for low sounds are disposed in the internal space S1. The loudspeakers 9 for low sounds are dynamic speaker units and have a diaphragm, a frame, a voice coil, and the like.

The loudspeakers 9 for low sounds are disposed such that their output side faces the back side of the television 1.

Sound passing holes are formed at positions in the rear cover 3*e* that correspond to the positions of the loudspeakers 9 for low sounds.

Sounds output from the loudspeakers 9 for low sounds are emitted into the external space through the sound passing holes of the rear cover 3*e*. Then, the sounds pass above or below the casing portion 3 and reach the front side of the television 1.

As the television 1 is viewed from the front side, the loudspeaker boxes 4*a* and 4*c* disposed on the left side output left-channel sounds. The loudspeaker boxes 4*a* and 4*c* disposed on the right side output right-channel sounds. Accordingly, sound output on a stereo mode is realized.

The loudspeakers 7 installed in the loudspeaker boxes 4 face the front side. Moreover, the four loudspeaker boxes 4 are disposed at positions symmetric to each other with respect to the center position of the display 2. Accordingly, a sound image is localized at the center portion of the display 2 and a favorable viewing environment in which images or pictures match sounds can be provided.

The loudspeaker boxes 4 may perform sound output on a mono mode.

The loudspeakers 9 for low sounds perform the sound output on the mono mode. As a matter of course, the loudspeakers 9 for low sounds can also perform the sound output on the stereo mode.

The specific configurations of the tweeter 7*a*, the loudspeakers 7*b* for middle sounds, and the loudspeakers 9 for low sounds are not limited, and may be arbitrarily designed.

[Loudspeaker Box]

Examples of the configuration of the loudspeaker box 4*a* and the installation of the loudspeaker box 4*a* into the television 1 will be described.

Figure 3:
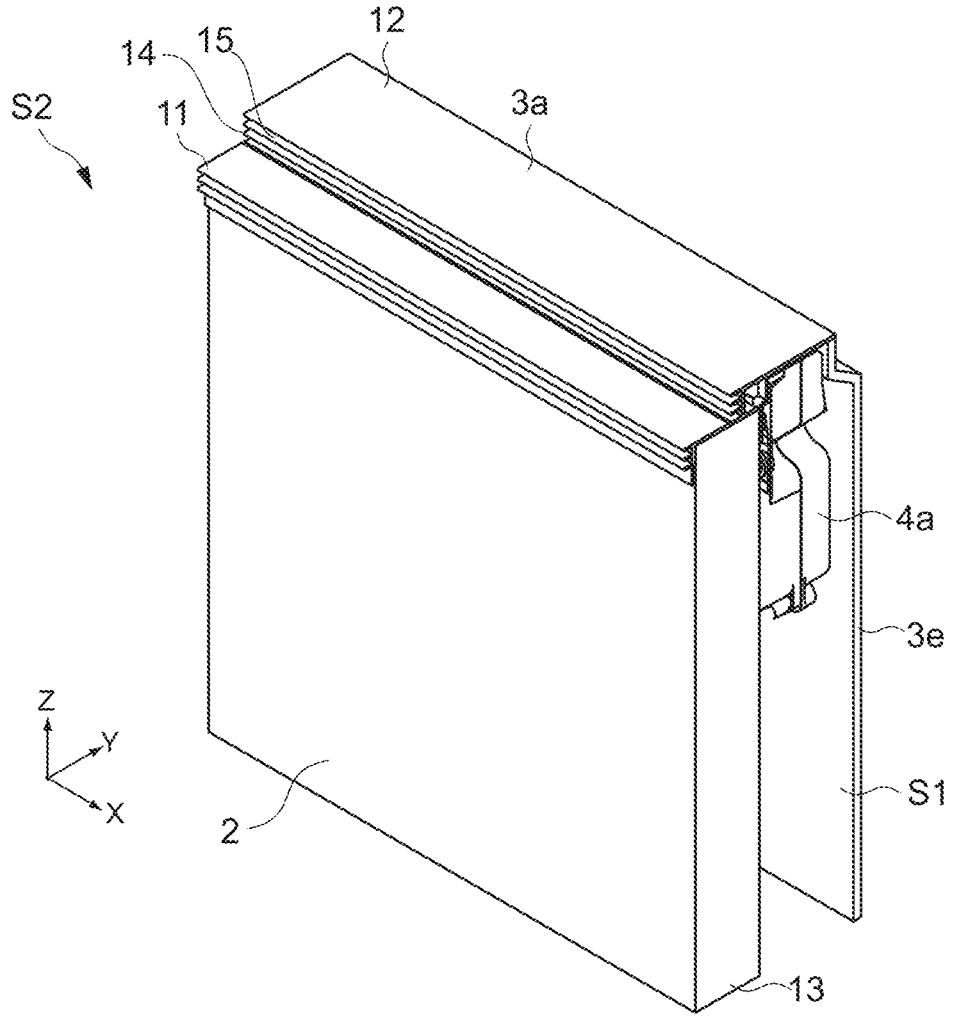
FIG. 3 An enlarged diagram of the portion of an upper left loudspeaker box shown in FIG. 1.

FIG. 3 is an enlarged diagram of the portion of the upper left loudspeaker box 4*a* shown in FIG. 1.

Figure 4:
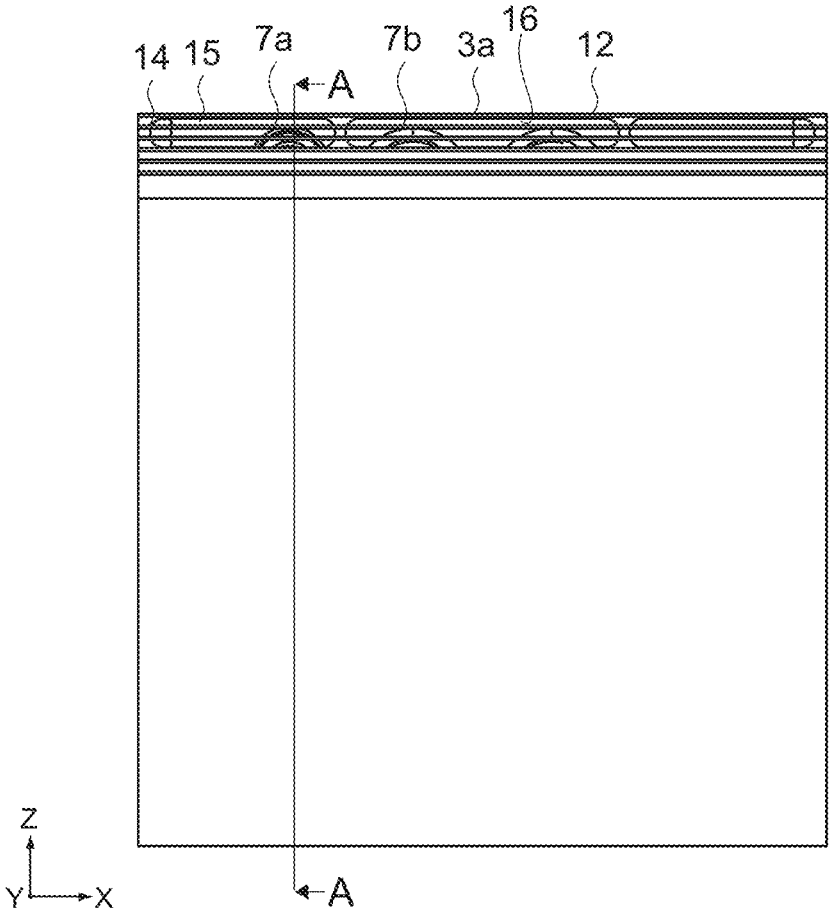
FIG. 4 A diagram of the enlarged portion shown in FIG. 3 as viewed from the front side of the television.

FIG. 4 is a diagram of the enlarged portion shown in FIG. 3 as viewed from on the front side of the television 1.

Figure 5:
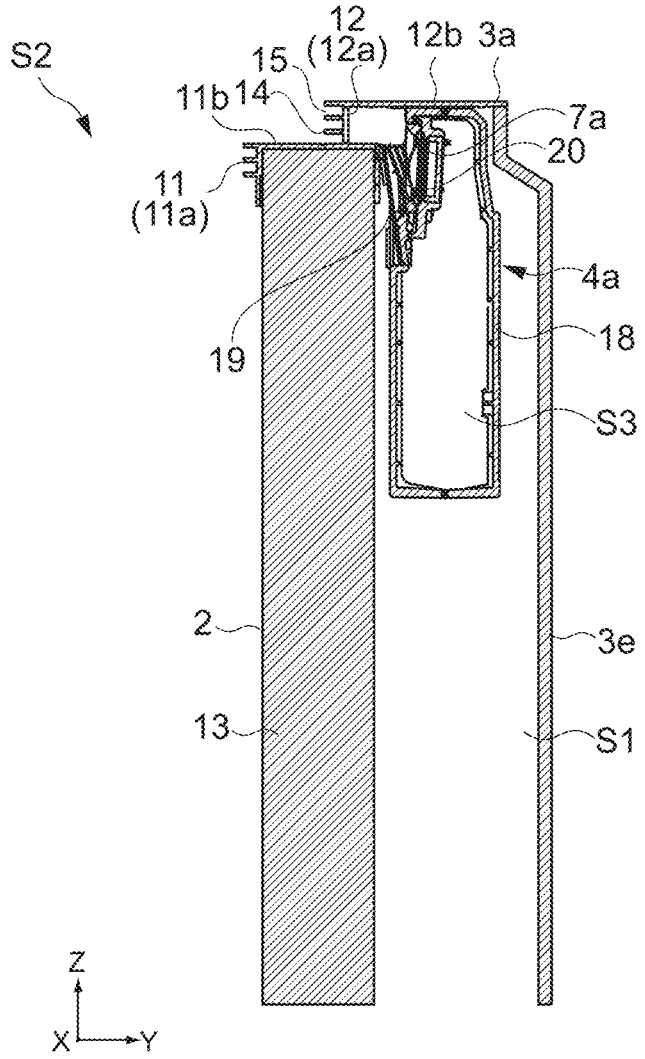
FIG. 5 A cross-sectional view schematically showing a cross-section taken along the line A-A of FIG. 4.

FIG. 5 is a cross-sectional view schematically showing a cross-section taken along the line A-A of FIG. 4.

FIG. 6 is a perspective view schematically showing an outer appearance example of the loudspeaker box 4.

As shown in FIGS. 3 and 5, the upper holding portion 3*a* has a stepped structure in which a first frame 11 constituting a first step portion and a second frame 12 constituting a second step portion are integrally configured.

The first frame 11 has a cross-section having a shape like a U-shape inverted upside down and includes a front surface portion 11*a*, an upper surface portion 11*b*, and a front surface portion 11*c*.

The second frame 12 has a cross-section having a shape like an L-shape turned to one side and includes a front surface portion 12*a* and an upper surface portion 12*b*.

The front surface portion 12*a* of the second frame 12*b* is coupled at the back position of the upper surface portion 11*b* of the first frame 11. The upper surface portion 11*b* of the first frame 11, the front surface portion 12*a* of the second frame 12, and the upper surface FIG. 12*b* of the second frame constitute the stepped structure.

A portion of the second frame 12, which is on the back side of the upper surface portion 11*b*, is connected to the rear cover 3*e*.

As shown in FIGS. 3 and 5, the display unit 13 including the display 2 is connected to the first frame 11 of the upper holding portion 3*a*.

The display unit 13 has a function of displaying images on the display 2.

The specific configuration of the display unit 13 is not limited. For example, the display 2, optical elements such as a diffusion plate, backlights, and the like are disposed. LEDs, LDs, or the like are installed as light sources for the backlights. Those devices are held by chassis or the like. The chassis are connected to the first frame 11. In addition, any configuration may be employed.

For example, the control boards 8 and the loudspeakers 9 for low sounds which are shown in FIG. 2 are disposed on the back side of the chassis or the like included in the display unit 13.

As shown in FIGS. 3 to 5, the front surface portion 12*a* of the second frame 12 has a plurality of fins 14 protruding to the front side of the television 1. Slits 15 are formed between the fins 14.

Moreover, as shown in FIG. 4, sound passing holes 16 are formed in the front surface portion 12*a* of the second frame 12. Therefore, the internal space S1 and an external space S2 of the television 1 are in communication with each other through the slits 15 and the sound passing holes 16.

As shown in FIG. 5, the loudspeaker box 4*a* is connected to the second frame 12 of the upper holding portion 3*a*.

As shown in FIG. 4, the loudspeaker box 4*a* is connected to the second frame 12 such that upper parts of the tweeter 7*a* and the loudspeakers 7*b* for middle sounds are at the same height as the positions of the slits 15 and the sound passing holes 16.

In other words, the loudspeaker box 4*a* is disposed such a position that the upper parts of the tweeter 7*a* and the loudspeakers 7*b* for middle sounds can be seen through the slits 15 and the sound passing holes 16 as those are viewed from the front side of the television 1.

Sounds output from the tweeter 7*a* and the loudspeakers 7*b* for middle sounds are emitted to the front side of the television 1 through the slits 15 and the sound passing holes 16.

Thus, in this embodiment, there is realized a so-called slit speaker configuration in which the loudspeaker boxes 4 are disposed on the deep side of the slits 15. Accordingly, the loudspeaker boxes 4 can be less prominent, which improve the design of the television 1. Moreover, a user who views a picture can concentrate on content displayed on the display 2 and can obtain a high sense of immersion. Moreover, high-quality sounds can be output at a sufficient sound pressure because the loudspeakers 7 with a diaphragm having a larger size can be installed.

It should be noted that although it is not shown in FIG. 5, the loudspeaker box 4*a* is fixed on the display unit 13 by screwing or the like. Accordingly, the loudspeaker box 4*a* can be sufficiently fixed.

As shown in FIG. 6, the loudspeaker box 4*a* includes a main body portion 18, the tweeter 7*a*, the loudspeakers 7*b* for middle sounds, and a reflector 19, and a partition structure 20.

The main body portion 18 generally has a cuboid shape closer to a plate shape. Moreover, the main body portion 18 is configured to be hollow.

As shown in FIGS. 5 and 6, an upper portion of a front surface portion 18*a* on the front side of the main body portion 18 is recessed backward to form a recess portion 21. As the recess portion 21 is viewed from the front side, the surface facing the front side is a mounting surface 22.

The tweeter 7*a* and the two loudspeakers 7*b* for middle sounds are disposed on the mounting surface 22 so as to be arranged in the left-and-right direction.

The tweeter 7*a* is disposed tilted upward by three degrees with respect to the front surface portion 18*a* of the main body portion 18. That is, the sound output direction of the tweeter 7*a* is tilted upward by three degrees with respect to the front surface portion 18*a*.

For example, it is assumed that the front surface portion 18*a* of the main body portion 18 is correctly made to face the front side of the television 1. In this case, the sound output direction of the tweeter 7*a* is tilted by three degrees with respect to the front direction (the Y direction).

As described above, in the present disclosure, the state in which it is disposed such that the output direction is deviated by three degrees is included in the concept of the output side of the tweeter 7*a* "being made to face the front side".

It should be noted that the loudspeakers 7*b* for middle sounds are disposed without being tilted upward. As a matter of course, the loudspeakers 7*b* for middle sounds may also be disposed tilted upward like the tweeter 7*a*.

Driving boards, power supply boards, and the like of the three loudspeakers 7 are disposed in an internal space S3 of the main body portion 18. The illustration and description of the internal configuration of the main body portion 18 are omitted. An arbitrary configuration for driving the three loudspeakers 7 may be used. Moreover, conventional technologies can be used for realizing such a configuration.

The portion surrounded by the internal space S3 of the main body portion 18 also functions as an enclosure for the three loudspeakers 7.

The reflector 19 is disposed at a position opposite to the mounting surface 22. That is, the reflector 19 is disposed on the sound output side of the loudspeakers 7.

As shown in FIG. 6, a bar-like cushion member 19*a* extending to the left and right is configured at an upper end portion of the reflector 19. This cushion member 19*a* is fixed at left and right end portions of the front surface portion 18*a* of the main body portion 18. Moreover, the lower end portion of the reflector 19 is connected to the lower end portion of the recess portion 21, which is formed at the front surface portion 18*a*.

Therefore, the reflector 19 is positioned to close the recess portion 21 as the loudspeaker box 4*a* is viewed from the front side.

Moreover, the reflector 19 is configured to cover and hide center portions and lower portions of the tweeter 7*a* and the loudspeakers 7*b* for middle sounds such that only the upper parts of the tweeter 7*a* and the loudspeakers 7*b* for middle sounds can be seen as the loudspeaker box 4*a* is viewed from the front side.

The upper parts of the tweeter 7*a* and the loudspeakers 7*b* for middle sounds, which are shown in FIG. 4 and which can be seen through the slits 15 and the sound passing holes 16, are substantially equal to portion not covered and hidden by the reflector 19.

[Partition Structure]

Figure 7:
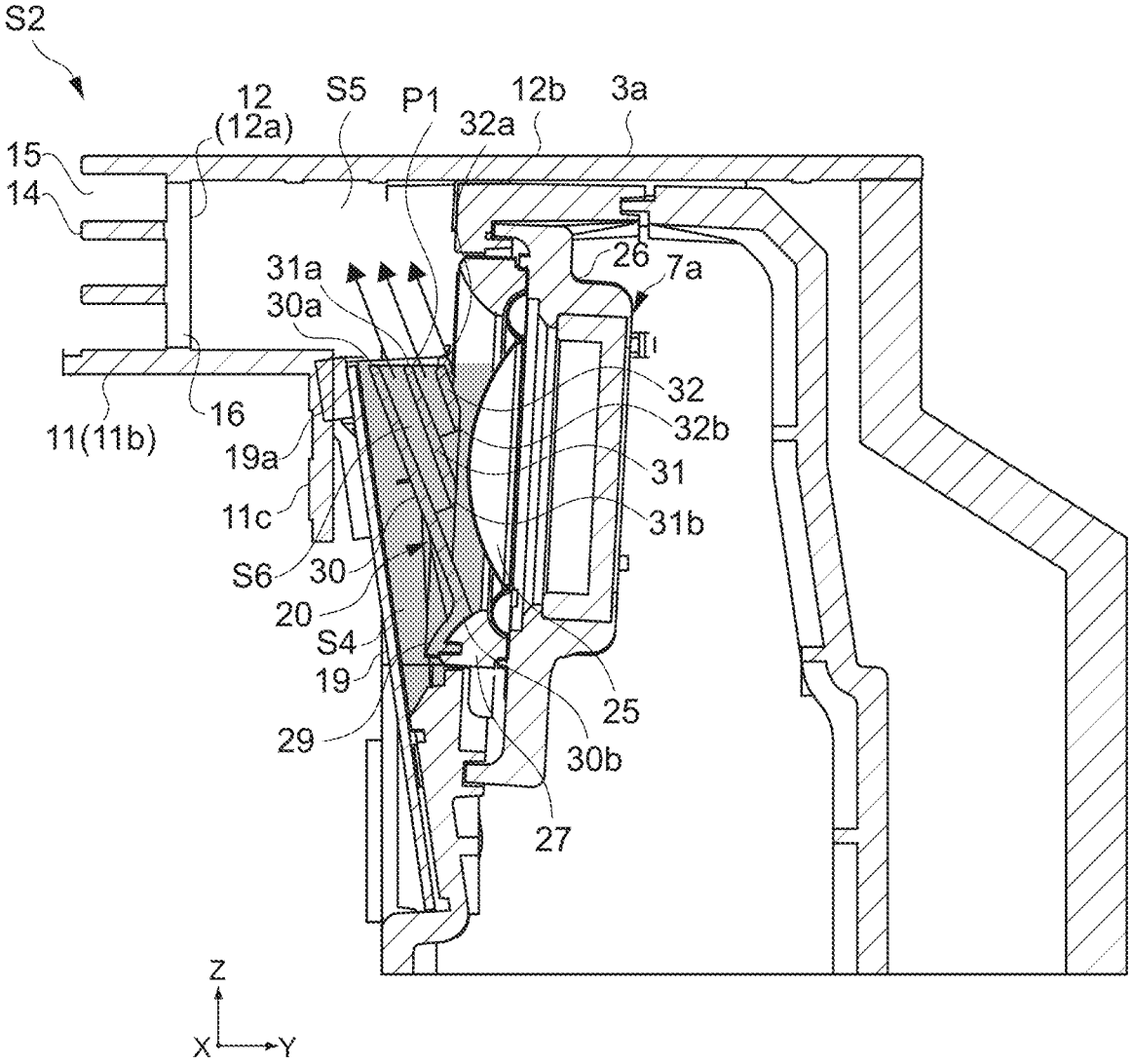
FIG. 7 An enlarged diagram as the portion of a partition structure in the cross-sectional view shown in FIG. 5.

FIG. 7 is an enlarged diagram in which a portion of the partition structure 20 in the cross-sectional view shown in FIG. 5 is enlarged.

FIGS. 8A, 8B, 9A and 9B are diagrams schematically showing the tweeter 7*a* in which the partition structure 20 is mounted.

Figure 8A:
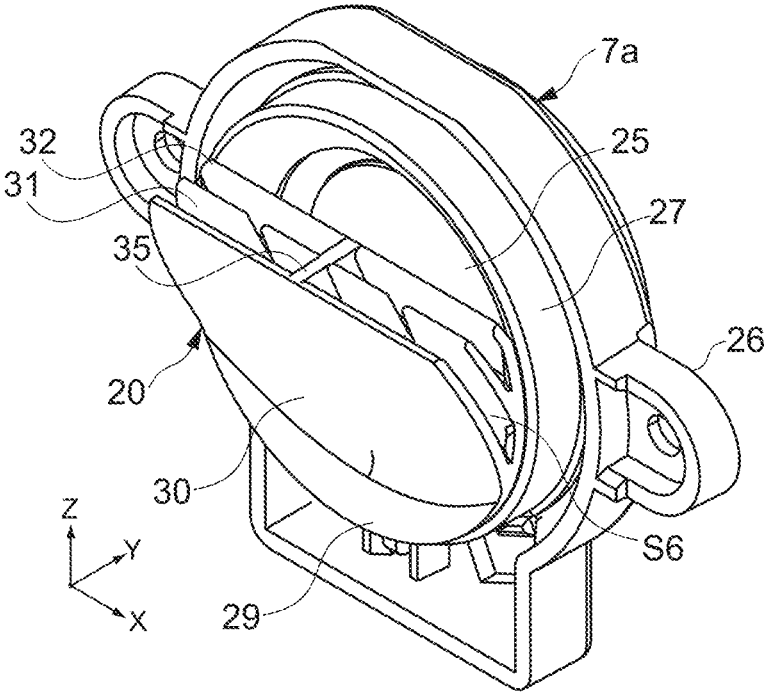
FIGS. 8A and 8B A diagram schematically showing a tweeter in which the partition structure is mounted.
Figure 8B:
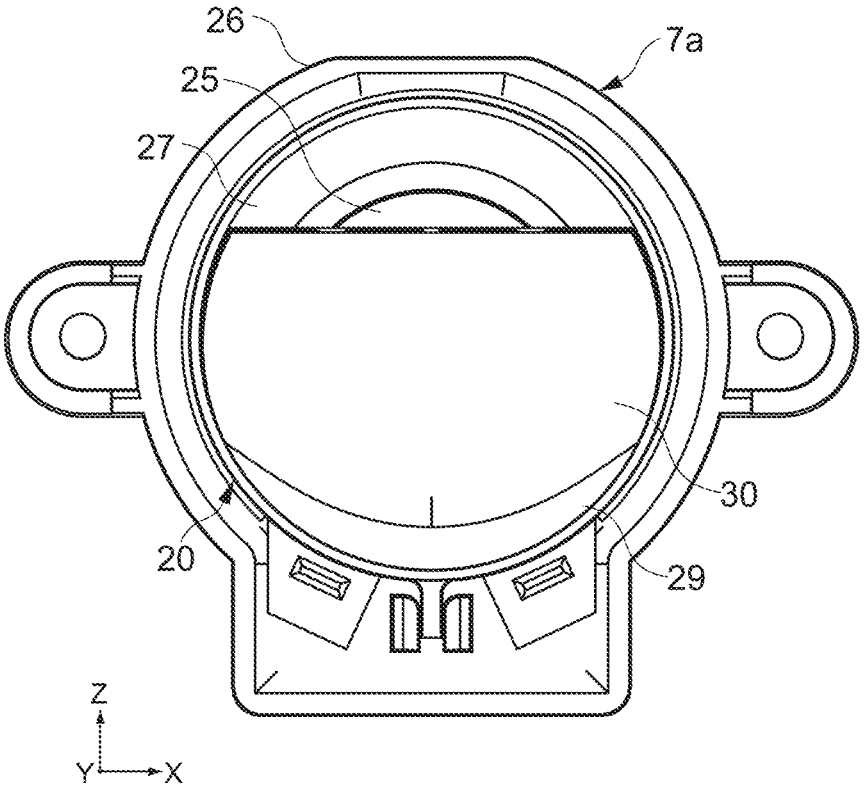
Figure 9A:
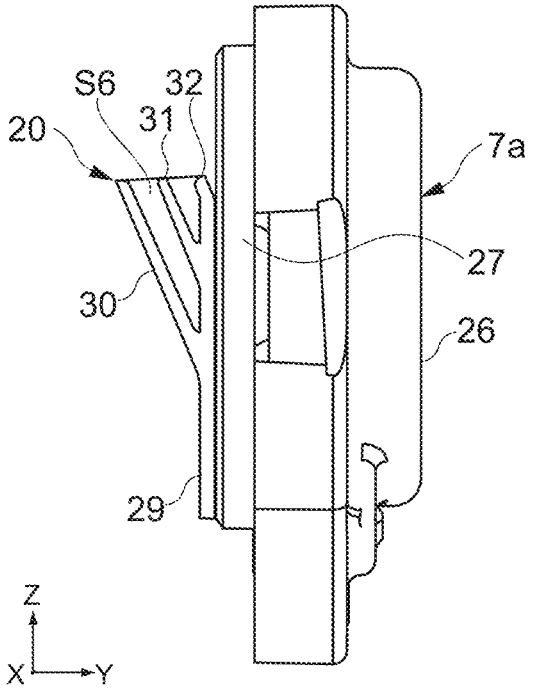
FIGS. 9A and 9B A diagram schematically showing the tweeter in which the partition structure is mounted.
Figure 9B:
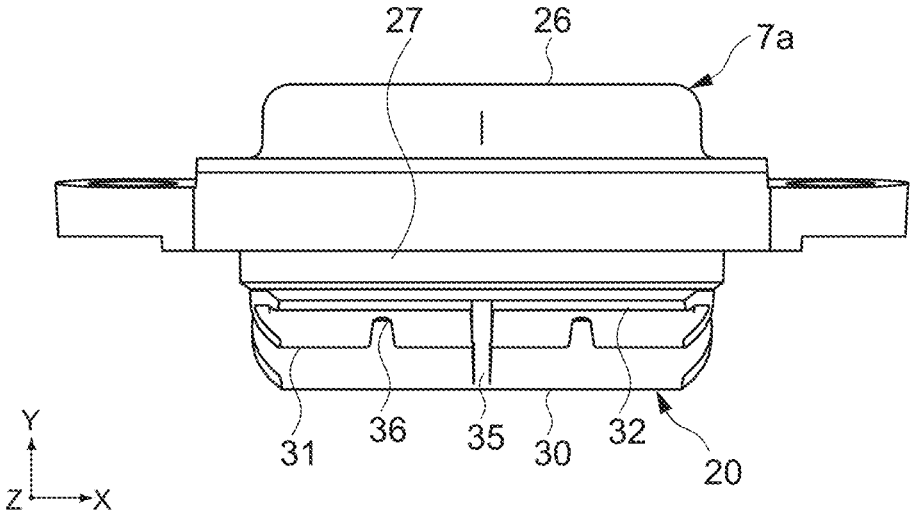

FIG. 8A is a perspective view as viewed from the front side obliquely. FIG. 8B is a front view as viewed from the front side. FIG. 9A is a side view as viewed from the right side. It is a plan view as viewed from the upper side.

Figure 10A:
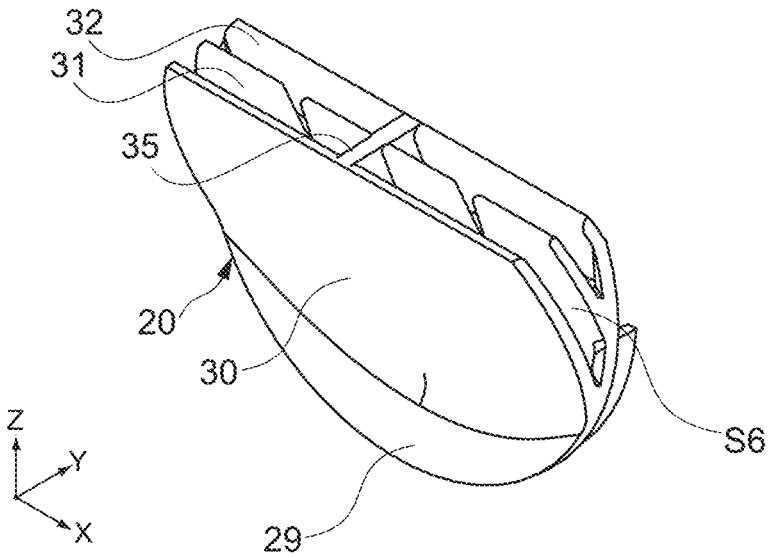
FIGS. 10A and 10B A diagram schematically showing the partition structure.
Figure 10B:
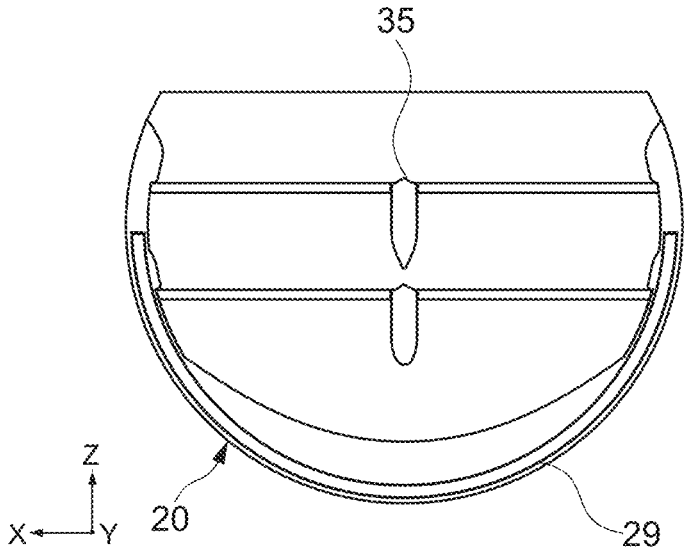
Figure 11A:
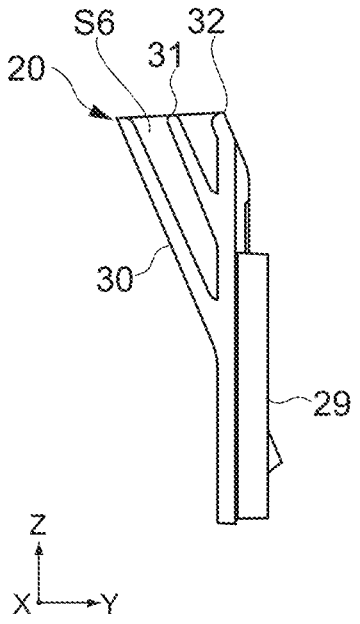
FIGS. 11A and 11B A diagram schematically showing the partition structure.
Figure 11B:
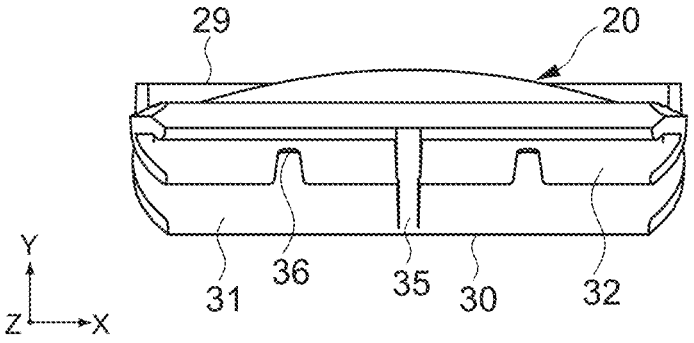

FIGS. 10 and 11 are diagrams schematically showing the partition structure 20. FIG. 10A is a perspective view as viewed from the front side obliquely. FIG. 10B is a diagram as viewed from the back side. That is, it is a diagram as viewed from the side of the tweeter 7*a* in which the partition structure 20 is mounted. FIG. 11A is a side view as viewed from the right side. FIG. 11B is a plan view as viewed from the upper side.

As shown in FIG. 7, the reflector 19 is disposed tilted toward the front side of the television 1. Accordingly, the reflector 19 has a function of efficiently guiding sounds output from the three loudspeakers 7 toward the sound passing holes 16 and the slits 15 formed in the front surface portion 12*a* of the second frame 12.

In this embodiment, with respect to sounds output from the loudspeakers 7*b* for middle sounds in which the partition structure 20 is not mounted, the function of efficiently guiding the sounds toward the sound passing holes 16 and the slits 15 is provided.

It should be noted that when the loudspeaker box 4*a* is mounted, the cushion member 19*a* configured at the upper end portion of the reflector 19 is sufficiently pushed and deformed against the front surface portion 11*c* of the first frame 11 of the upper holding portion 3*a* (the illustration of the deformed state is omitted). Accordingly, a clearance is prevented from being formed between the front surface portion 11*c* and the loudspeaker box 4*a*. As a result, sounds output from the loudspeakers 7*b* for middle sounds can be efficiently guided toward the sound passing holes 16 and the slits 15.

The reflector 19 forms a gap space S4 (gray portion) between the reflector 19 and the tweeter 7*a*. The gap space S4 is a space formed between the reflector 19 and the tweeter 7*a* when the reflector 19 is disposed on the sound output side of the tweeter 7*a* (i.e., the front side).

Moreover, the gap space S4 is a space communicating with the external space S2. In this embodiment, the gap space S4 is in communication with the external space S2 via the internal space S5, the sound passing holes 16, and the slits 15 of the second frame 12.

Moreover, the gap space S4 has an opening portion P1 opened toward the side communicating with the external space S2.

Sounds output from the tweeter 7*a* are emitted toward the external space S2 from the gap space S4 through the opening portion P1.

In this embodiment, the gap space S4 is a space sandwiched by portions in which the reflector 19 and the tweeter 7*a* overlap each other as the reflector 19 and the tweeter 7*a* are viewed from the sound output side (i.e., the front side) of the tweeter 7*a*. The opening portion P1 is a portion of the gap space S4 which is at the upper end portion of the reflector 19 (the cushion member 19*a*).

That is, as the reflector 19 and the tweeter 7*a* are viewed from the sound output side of the tweeter 7*a*, the opening portion P1 is configured at the position of an end portion of the reflector 19, the end portion being located on the side of the portion in which the tweeter 7*a* can be seen.

It should be noted that the present technology is not limited to the case where the gap space S4 and the opening portion P1 are defined in the above-mentioned manner.

Arbitrary space and opening portion which correspond to the space formed between the reflector 19 and the tweeter 7*a* and the opening portion on the side of the portion of that space, which is in communication with the external space S2, can be the gap space S4 and the opening portion P1 according to the present technology.

For example, a space up to a plane connecting the upper end portion of the reflector 19 and an upper end portion of the tweeter 7*a* to each other may be used as the gap space S4 and an opening portion on the side communicating with the external space S2 may be used as the opening portion P1.

Alternatively, a space up to a plane extending from the upper end portion of the reflector 19 in the sound output direction of the tweeter 7*a* may be used as the gap space S4 and an opening portion on the side communicating with the external space S2 may be used as the opening portion P1.

Alternatively, a perpendicular line may be drawn from the upper end portion of the reflector 19 toward the tweeter 7*a*, a space up to a portion of intersection therebetween may be used as the gap space S4, and the opening portion on the side communicating with the external space S2 may be used as the opening portion P1.

As shown in FIGS. 8A, 8B, 9A and 9B and the like, the tweeter 7*a* includes a diaphragm 25 and a holding member 26. The holding member 26 holds the diaphragm 25, the voice coil (not shown), a magnetic circuit, which is constituted by a magnet, a yoke, and the like, and the like.

A portion disposed around the diaphragm 25 as the tweeter 7*a* is viewed from the front side is the frame 27.

In this embodiment, the diaphragm 25 has a circular shape as viewed from the front side and the frame 27 also has a ring shape so as to conform to the shape of the diaphragm 25.

It should be noted that the present technology is not limited to the circular and track speaker units, and the present technology can be applied to any shape of loudspeaker unit. Moreover, the output properties of the loudspeaker unit and the like are also not limited, and the present technology can also be applied to a squawker, a woofer, and the like other than the tweeter.

In a case where the gap space is formed by disposing an object on the sound output side of the loudspeaker units, the partition structure can be configured with respect to the object.

The partition structure 20 is capable of dividing the gap space S4 into a plurality of spaces. Moreover, the partition structure 20 is capable of guiding sounds output from the tweeter 7*a* toward the opening portion P1 of the gap space S4. That is, the partition structure 20 is capable of guiding sounds output from the tweeter 7*a* toward the external space.

The partition structure 20 is integrally formed by injection molding with resin, for example. The resin material is not limited, and any resin material may be used. For example, generally used resins such as ABS (acrylonitrile/butadiene/styrene) resin, engineering plastic such as PC resin and ABS and PC blends, and the like are used.

In addition, a material other than the resin material may be used.

As shown in FIG. 7 and the like, the partition structure 20 has a connecting portion 29, which is connected to the tweeter 7*a*, and a plurality of plate-like members 30 to 32.

As shown in FIGS. 8A, 8B, 9A and 9B and the like, the connecting portion 29 is connected to a frame disposed around the diaphragm 25 of the tweeter 7*a*. Moreover, the connecting portion 29 is held in contact with a portion of the frame 27, the portion being located on a opposite side to the side of the opening portion P1 of the gap space S4.

In this embodiment, the opening portion P1 is configured at an upper end portion of the gap space S4. Therefore, the upper portion of the frame 27 is the portion on the side of the opening portion P1. The lower portion of the frame 27 is the portion on the side opposite to the side of the opening portion P1.

The connecting portion 29 of the partition structure 20 is connected to the lower portion of the frame 27 so as to be held in contact with the frame 27. Accordingly, sounds output from the tweeter 7*a* are guided toward the opening portion P1 on the upper side without allowing sounds output from the tweeter 7*a* to leak out downward.

As shown in FIGS. 8A, 8B, 9A and 9B, the connecting portion 29 is held in contact with the frame 27 to cover more than half of the circular region from the lower side to the upper side of the frame 27.

Therefore, it can also be said that the connecting portion 29 is disposed based on a position opposite to the opening portion P1 of the gap space S4.

Otherwise, it can also be said that the connecting portion 29 is connected based on a position of the frame 27 that is furthest from the opening portion P1. In this embodiment, a lowermost end position of the frame 27 corresponds to the position furthest from the opening portion P1.

In any case, it is sufficient that the connecting portion 29 is configured and connected to the frame 27 such that sounds output from the tweeter 7*a* can be guided toward the opening portion P1 on the upper side without allowing sounds output from the tweeter 7*a* to leak out downward.

It should be noted that the connecting portion 29 of the partition structure 20 may be connected to the portion other than the frame 27 of the holding member 26.

The plurality of plate-like members 30 to 32 has a plate shape. The plate shape is not limited to the planar shape, and also has a plate shape with a curved surface like a bent plate.

Moreover, the plurality of plate-like members 30 to 32 is disposed in the gap space S4. It should be noted that being disposed in the gap space S4 includes a state in which at least parts of the plate-like members 30 to 32 are included in the gap space S4.

Moreover, the plurality of plate-like members 30 to 32 extends toward the opening portion P1 of the gap space S4 and is configured to guide sounds output from the tweeter 7*a* toward the external space S2.

As shown in FIG. 7 and the like, in this embodiment, the three plate-like members 30 to 32 are configured. The plate-like members 30 to 32 have a planar shape and are disposed tilted forward. That is, the plate-like members 30 to 32 are disposed to have upper end portions 30*a* to 32*a* located more forward than lower end portions 30*b* to 32*b*. Moreover, the upper end portions 30*a* to 32*a* are aligned at the position of the opening portion P1.

Moreover, the plate-like members 30 to 32 are configured to be parallel to each other inside the gap space S4. The plate-like members 30 to 32 are configured integrally with the connecting portion 29.

The plate-like members 30 to 32 divide the gap space S4 into the plurality of spaces. For example, a divided space S6 is formed between the plate-like members adjacent to each other.

In the sound output direction of the tweeter 7*a*, a plate-like member 30 that is disposed at the position furthest from the tweeter 7*a* and the end portion (the lower end portion) 30*b* on the side of the tweeter 7*a* is coupled to the connecting portion 29.

Moreover, as shown in FIG. 8B, the plate-like member 30 is configured to cover and hide the diaphragm 25 in the region from the position of the connecting portion 29 (the position furthest from the opening portion P1) to the end portion on the side of the opening portion P1 as the diaphragm 25 is viewed from the sound output side of the tweeter 7*a*.

Accordingly, sounds output from the tweeter 7*a* can be efficiently guided toward the opening portion P1 on the upper side without allowing sounds output from the tweeter 7*a* to leak out downward.

Regarding the plate-like members 31 and 32 that are disposed closer to the tweeter 7*a* than the plate-like member 30, clearances are formed between the end portions (the lower end portions) 31*b* and 32*b* on the side of the tweeter 7*a* and the connecting portion 29.

The sizes of the plate-like members 31 and 32 in the left-and-right direction are set such that the plate-like members 31 and 32 can cover and hide the diaphragm 25 as in the plate-like member 30.

As those are schematically shown with the arrows in FIG. 7, sounds output from the tweeter 7*a* pass through the divided space S6 and are guided toward the opening portion P1 of the gap space S4. The sounds guided to the gap space S4 are emitted into the external space S2 through the internal space S5, the sound passing holes 16, and the slits 15 of the second frame 12.

It should be noted that the space between the plate-like member 32 disposed at the position closest to the tweeter 7*a* and the tweeter 7*a* is also included in the divided space S6.

In this embodiment, as the reflector 19 and the tweeter 7*a* are viewed from the sound output side of the tweeter 7*a* as described above, the reflector 19 is disposed to cover and hide a part of the diaphragm 25. The plurality of plate-like members 30 to 32 is configured to be capable of guiding sounds output from the tweeter 7*a* toward the visible part of the diaphragm 25.

Figure 12:
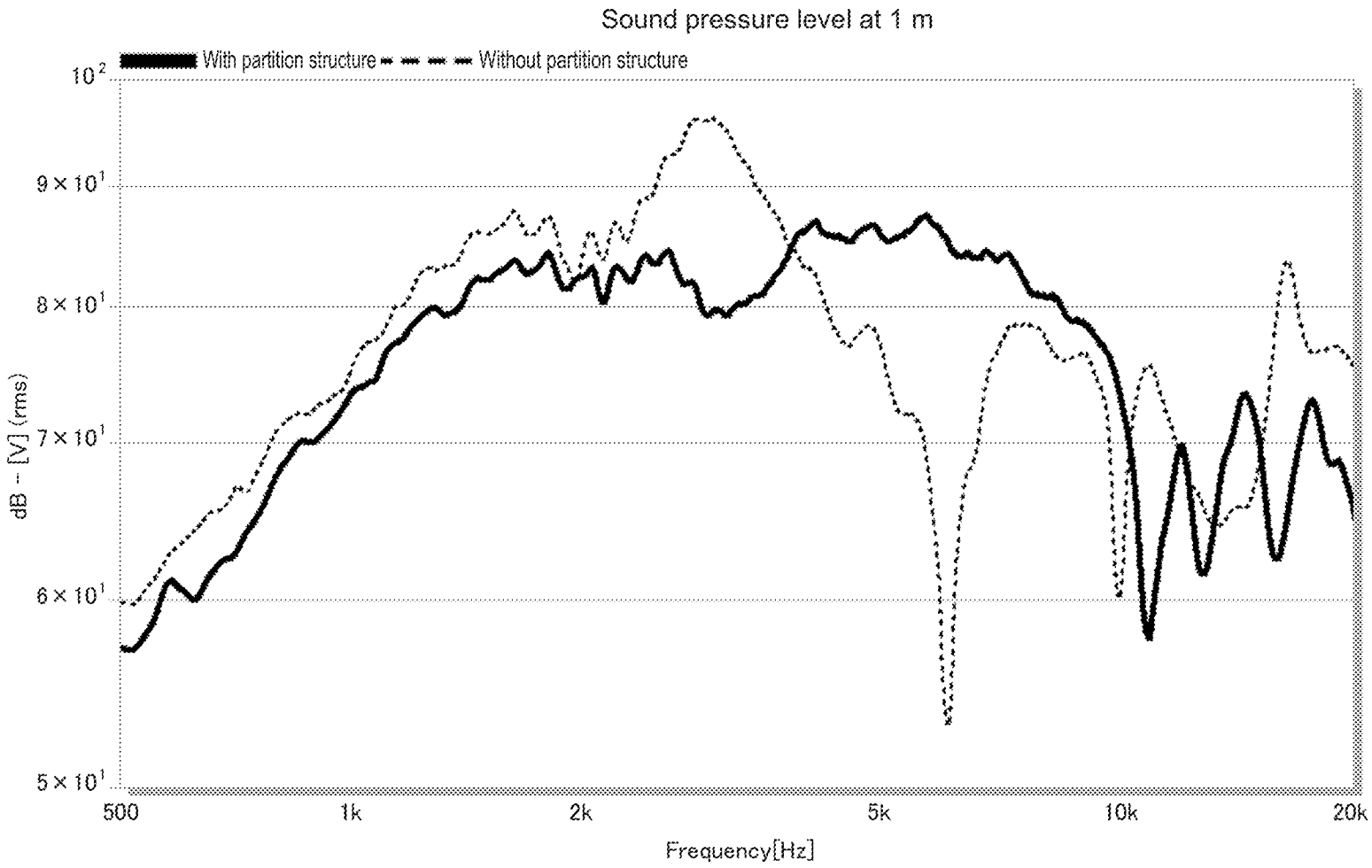
FIG. 12 A graph showing frequency characteristics of the sound pressure level depending on with or without the partition structure.

FIG. 12 is a graph showing frequency characteristics of a sound pressure level depending on with or without the partition structure 20. As in the television 1, a loudspeaker capable of outputting sounds in the range of 500 Hz to 20 kHz with a slit speaker configuration was prepared. Then, a sound pressure level in a case where the partition structure 20 is mounted in the loudspeaker and a sound pressure level in a case where the partition structure 20 is not mounted in the loudspeaker are measured at the position spaced away from the loudspeaker by one meter.

As shown in FIG. 12, an improvement by about 10 dB or more was found in the range of approximately 4 kHz to 8 kHz.

In a case where the partition structure 20 shown in FIG. 7 and the like is not mounted, the reflector 19 collectively reflects the energy of sounds output from the loudspeaker. Therefore, a problem in that the sound pressure greatly attenuates especially in the high range in which sounds more tend to exhibit straight traveling properties can arise. Moreover, a problem in that strong peaks/dips are caused by a resonance in the gap space S4 between the loudspeaker and the reflector 19 and the frequency characteristics are significantly degraded can also arise. In this embodiment, peaks/dips were caused at several kHz because lengths of reflection paths on which sounds travel the gap space S4 while undergoing reflection match wavelengths of frequencies in the reproduction frequency range of the tweeter.

In contrast, the provision of the partition structure 20 can divide the gap space S4 into the plurality of spaces. Accordingly, the energy of sounds reflected by the plate-like members 30 to 32 can be dispersed. As a result, the attenuation of the sound pressure can be sufficiently reduced also in the high range in which sounds more tend to exhibit straight traveling properties.

Moreover, the influence of a resonance in the gap space S4 can also be reduced. That is, the frequencies at which peaks/dips are caused can be increased to higher frequencies because reflection paths on which sounds travel the divided space S6 while undergoing reflection is shortened. In this embodiment, the frequencies at which peaks/dips are caused can be increased to 10 kHz or more as shown in FIG. 12. As a result, the frequency characteristics can be improved in the range of about 4 kHz to 8 kHz that corresponds to the reproduction frequency range of the tweeter 7*a*.

As shown in FIG. 8B, in this embodiment, the plate-like members 30 to 32 are disposed to cover and hide the diaphragm 25, specifically, the region from the lower portion to the upper portion of the diaphragm 25. With this configuration, it was possible to sufficiently reduce sounds that reach the reflector 19 and a high effect was obtained.

Moreover, as shown in FIG. 7 and the like, in this embodiment, the three plate-like members 30 to 32 are disposed tilted forward. Accordingly, sounds output from the tweeter 7*a* can be efficiently guided to the opening portion P1, and the attenuation of the sound pressure level can be reduced.

Moreover, as shown in FIGS. 7, 8A, and 8B and the like, in this embodiment, the divided space S6 is configured to be opened in the left-and-right direction orthogonal to the extending direction of the plate-like members 30 to 32, i.e., the direction in which the plate-like members 30 to 32 extend toward the opening portion P1 from the tweeter 7*a*. That is, the left and right side surface sides of the partition structure 20 are not closed but opened. Accordingly, it is possible to sufficiently reduce peaks and the like caused by a resonance occurring in the divided space S6 divided by the plate-like members 30 to 32.

Moreover, as shown in FIGS. 8A, 8B, 9A, and 9B and the like, the partition structure 20 has a reinforcing rib 35 formed at the center portion. The plate-like members 30 to 32 are connected to each other through this reinforcing rib 35. Accordingly, the rigidity of the partition structure 20 (the rigidity of each plate-like member) can be enhanced. Moreover, cutouts 36 are formed in the plate-like member 31 for reinforcing a mold.

Employing the partition structure 20 also for the other loudspeaker boxes 4 shown in FIGS. 1 and 2 provides similar effects. It should be noted that the loudspeaker boxes 4 and the partition structure 20 do not need to all have the same configurations, and may be designed as appropriate.

In this embodiment, the television 1 corresponds to the embodiment of the electronic apparatus.

The loudspeaker boxes 4 corresponds to the loudspeaker apparatus.

The tweeter 7*a* corresponds to a loudspeaker that outputs sounds. Moreover, the tweeter 7*a* has a loudspeaker portion and a structure and is also an embodiment of the loudspeaker according to the present technology. The portion constituting the loudspeaker unit described above corresponds to the loudspeaker portion.

The partition structure 20 corresponds to the structure configured with respect to an object that is disposed on the sound output side of the loudspeaker and forms a gap space communicating with the external space between the object and the loudspeaker.

The reflector 19 corresponds to an object that is disposed on a sound output side of the loudspeaker and forms, between the object and the loudspeaker, a gap space communicating with an external space.

The plurality of plate-like members 30 to 32 corresponds to one or more plate-like members.

The plate-like member 30 corresponds to a first member.

The plate-like members 31 and 32 correspond to one or more second members.

As described above, the loudspeaker boxes 4 according to this embodiment includes the partition structure 20 configured with respect to the reflector 19 disposed on the sound output side of the tweeter 7*a*. The partition structure 20 includes the plurality of plate-like members 30 to 32 that is disposed in the gap space S4 between the reflector 19 and the tweeter 7*a* and guides sounds output from the tweeter 7*a* into the external space S2 from the gap space S4. Accordingly, it is possible to prevent the sound quality from being affected while employing the configuration to cover and hide the sound output side of the tweeter 7*a*. As a result, a high-quality and sufficient sound pressure can be output without degrading the design.

For example, it is possible to output high-quality sounds while employing a structure having a narrower aperture for emitting sounds than the area of the diaphragm 25. For example, realizing the slit speaker configuration or the like makes it possible to perform front emission and in particular to ensure the quality in the high audio range without degrading the design. Moreover, the sound quality is not easily affected by the installation environment because it is unnecessary to emit sounds to the front side through a reflection. Moreover, the loudspeaker boxes 4 can be disposed on the upper side of the set.

Moreover, it is possible to prevent attenuation of sounds in the high range, which would be difficult to be ensured in a case where an obstacle is present in front of the diaphragm 25, because the partition structure 20 divides and causes sound waves to flow obliquely. Moreover, deterioration of frequency characteristics due to a resonance can be prevented because frequencies at which a resonance occurs can be increased to a significantly high frequency due to the division of the gap space S4.

Other Embodiments

The present technology is not limited to the above-mentioned embodiments, and various other embodiments can be realized.

In the above-mentioned embodiments, as shown in FIG. 7 and the like, the plate-like members 30 to 32 are configured inside the gap space S4. In other words, the plate-like members 30 to 32 are configured such that the whole of the plate-like members 30 to 32 is included in the gap space S4. However, the present technology is not limited to such a configuration.

FIGS. 13 to 16 are schematic diagrams showing configuration examples of a partition structure according to another embodiment.

Figure 13:
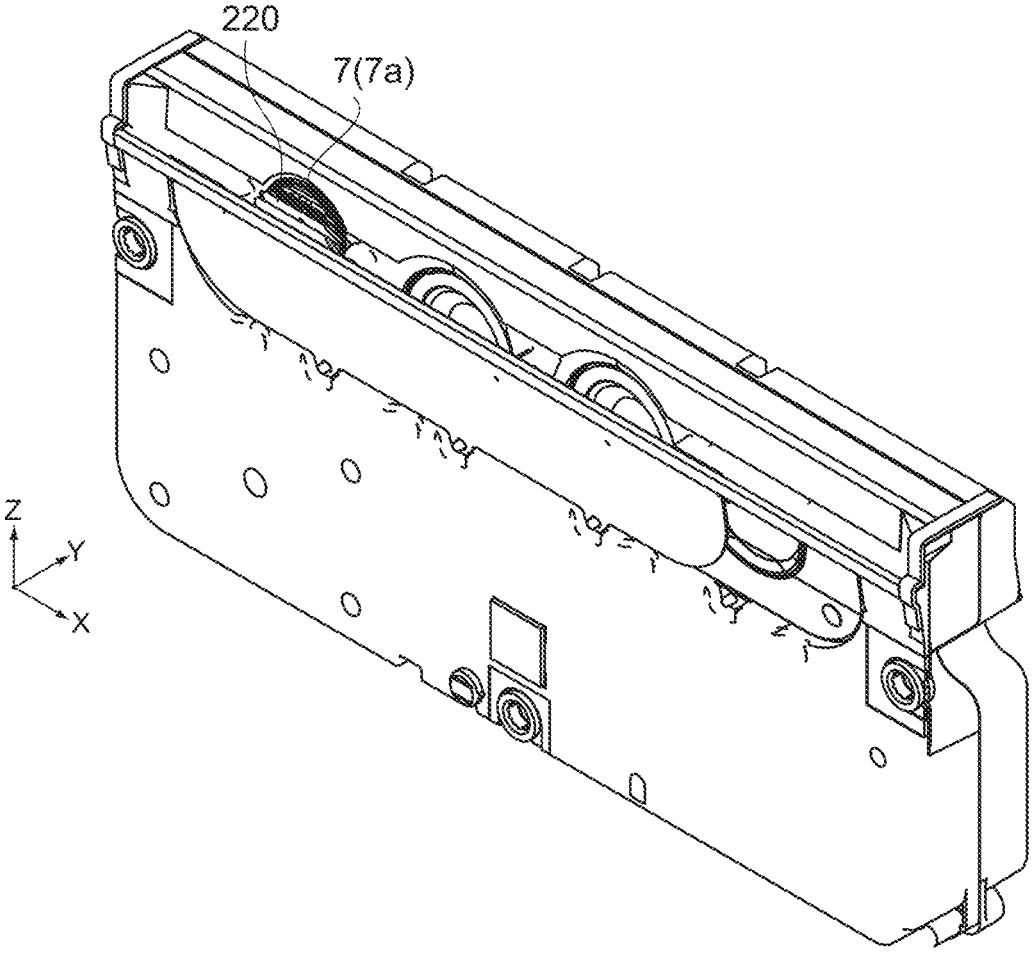
FIG. 13 A schematic diagram showing a configuration example of a partition structure according to another embodiment.
Figure 14:
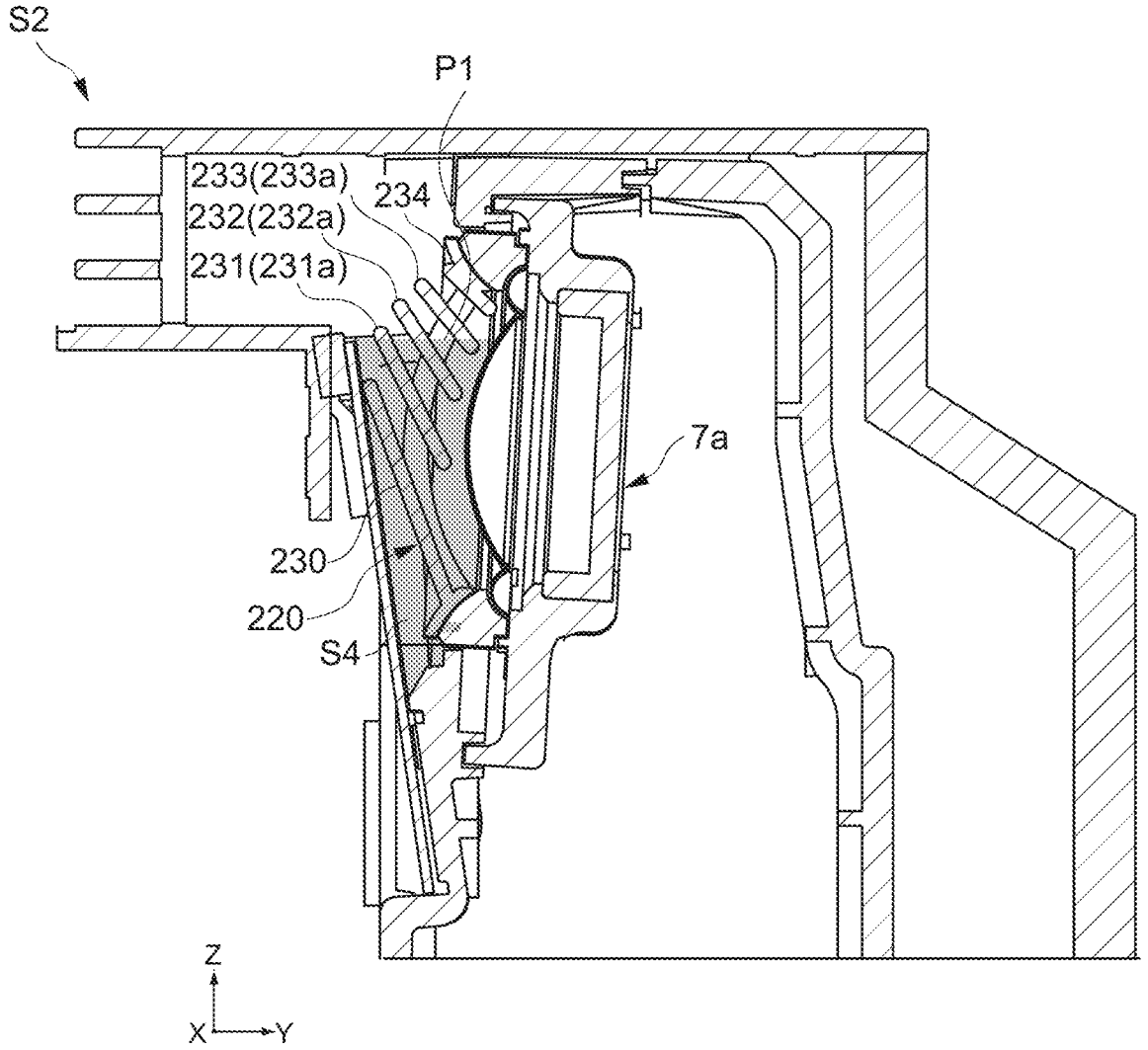
FIG. 14 A schematic diagram showing a configuration example of the partition structure according to the other embodiment.

In a partition structure 220 shown in FIGS. 13 and 14, five plate-like members 230 to 234 are configured. Those plate-like members 230 to 234 are not parallel to each other and are configured to have different angles of inclination.

Moreover, plate-like members 231 to 233 have upper end portions 231*a* to 233*a* to protrude outward from the opening portion P1 of the gap space S4. Moreover, the whole of a plate-like member 234 is disposed outside the gap space S4. Accordingly, sounds output from the tweeter 7*a* can be efficiently guided to the opening portion P1 and the external space S2.

Figure 15:
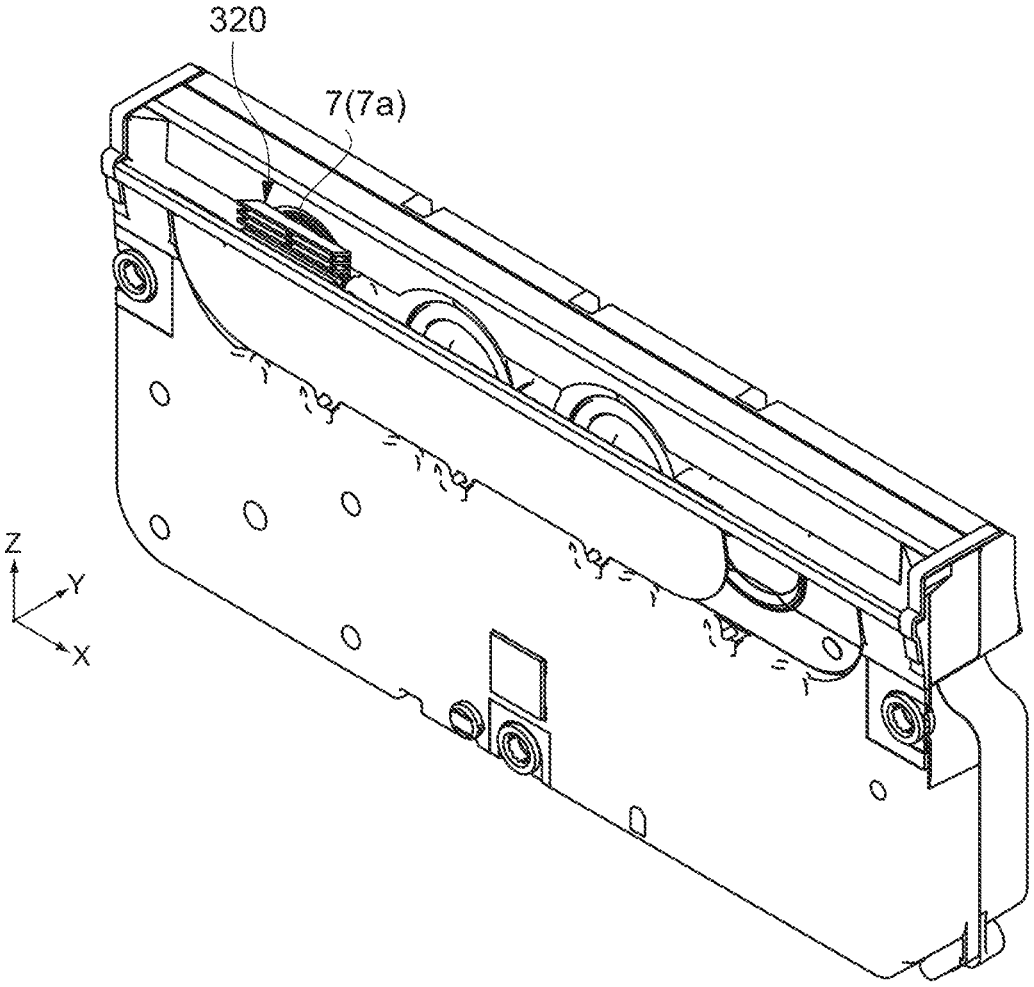
FIG. 15 A schematic diagram showing a configuration example of the partition structure according to the other embodiment.
Figure 16:
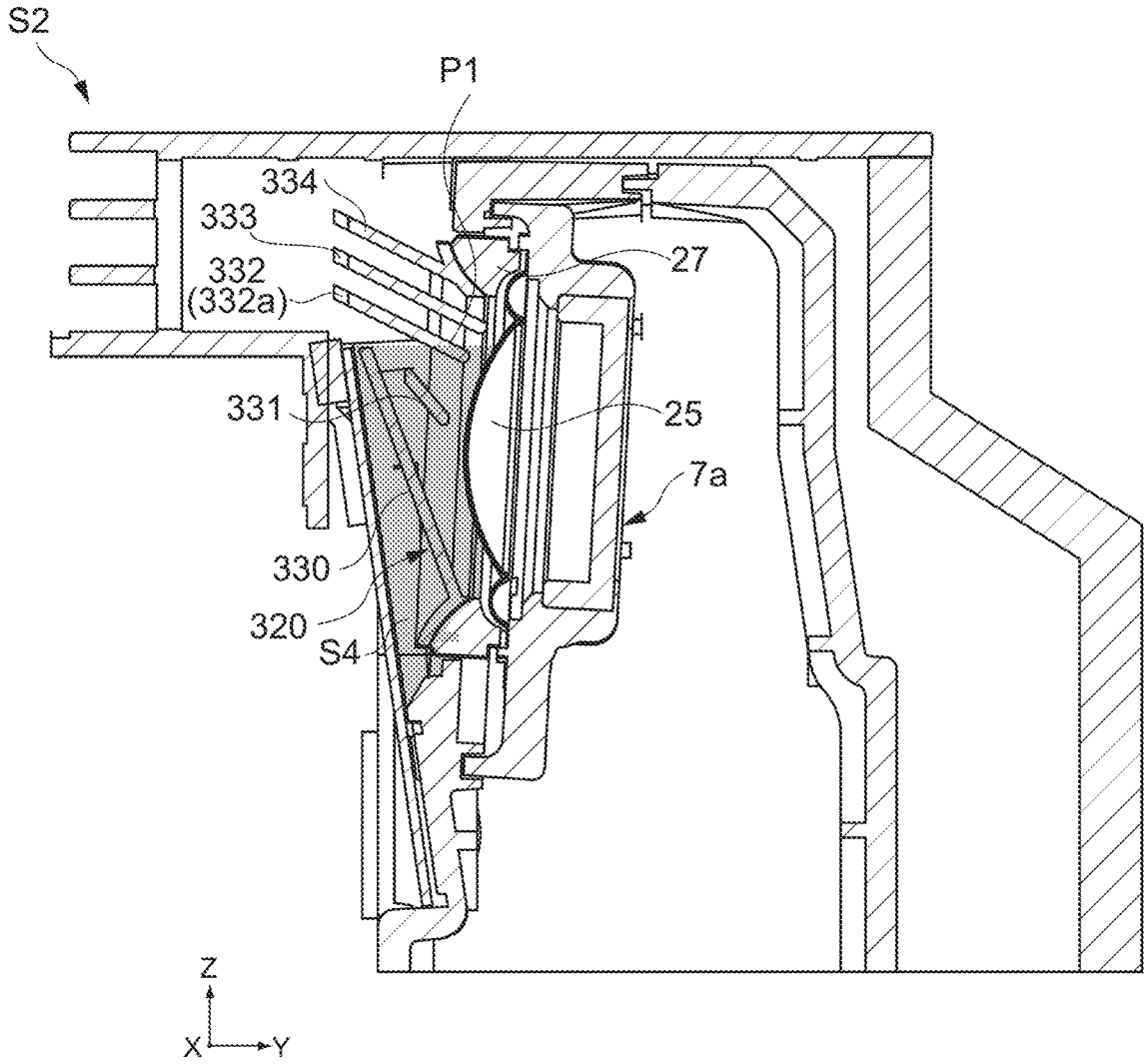
FIG. 16 A schematic diagram showing a configuration example of the partition structure according to the other embodiment.

Five plate-like members 230 to 234 are configured in a partition structure 320 shown in FIGS. 15 and 16. Three upper plate-like members 332 to 334 of those plate-like members 330 to 234 are configured to be parallel to each other. The plate-like members 330 and 331 are configured to have angles of inclination different from those plate-like members 332 to 334. Moreover, the plate-like members 330 and 331 are configured to have angles of inclination different from each other.

Moreover, the plate-like member 332 has an upper end portion 332*a* protruding outward from the opening portion P1 of the gap space S4. Moreover, the whole of the plate-like members 333 and 334 is disposed outside the gap space S4. In addition, the uppermost plate-like member 334 is connected to the frame 27 of the tweeter 7*a*. That is, in the partition structure 320, the plate-like members 330 to 334 are disposed to cover the whole of the diaphragm 25.

Accordingly, sounds output from the tweeter 7*a* can be efficiently guided to the opening portion P1 and the external space S2.

The example in which the reflector 19 provided in the loudspeaker boxes 4 corresponds to an "object" according to the present technology has been shown above. That is, the example in which a "loudspeaker apparatus" according to the present technology includes the "object".

The present technology is not limited thereto, and the present technology can also be applied in a case where the "object" is a part of an "electronic apparatus" in which the "loudspeaker apparatus" is installed. That is, the "object" may be disposed on the sound output side of the loudspeaker in a state in which the "loudspeaker apparatus" is incorporated in the "electronic apparatus".

For example, it is assumed that the reflector 19 is not provided in the loudspeaker boxes 4 shown in FIG. 6. It is also assumed that components and the like of the television 1 are disposed on the sound output side of the tweeter 7*a* when those loudspeaker boxes 4 are incorporated in the television 1. For example, it is also assumed that the front surface portion 11*c* of the first frame 11 shown in FIG. 7 is disposed on the front side of the tweeter 7*a* and covers and hides a part of the tweeter 7*a*.

Also in such a case, a "structure" according to the present technology can be configured with respect to, for example, the front surface portion 11*c* disposed on the front side of the tweeter 7*a*.

That is, the present technology can be carried out both in a case where the "loudspeaker apparatus" includes the "object" and in a case where the "loudspeaker apparatus" does not include the "object".

Hereinabove, the plurality of plate-like members is disposed as the "structure" according to the present technology. The present technology is not limited thereto, and the effects can be provided also in a case where a single plate-like member is disposed. For example, the "structure" may be constituted only by a "first member" according to the present technology.

The angles of inclination of the plate-like members with respect to the sound output direction of the loudspeakers are not limited. For example, the plate-like members may be disposed along the direction orthogonal to the sound output direction.

The end portions of the plate-like members, which are on the side of the upper end portion (the opening portion), may be configured to be inclined to one of the left and right as the plate-like members are viewed from the front side. For example, the upper end portions of the plate-like members are configured to be oblique in accordance with the positions at which the loudspeaker units are disposed. Accordingly, the sound directivity properties can be controlled.

As also described above, the application of the present technology is not limited to the tweeter. The structure can be mounted in a loudspeaker for an arbitrary reproduction frequency range.

Electronic apparatuses to which the present technology can be applied are not limited to televisions. Moreover, the electronic apparatuses to which the present technology can be applied is not limited to an electronic apparatus capable of displaying pictures. For example, the present technology can be applied to any electronic apparatus including portable phones, smartphones, personal computers, game consoles, digital cameras, audio devices, TVs, projectors, car navigation systems, wearable information devices (eyeglass-type, wristband-type), operation devices such as remote controllers, IoT devices connected to the Internet or the like, and the like.

The electronic apparatus, the respective configurations such as the loudspeaker boxes, the loudspeakers (the loudspeaker units), the structure, the manufacturing method for the structure, and the like, which have been described with reference to each of the drawings, are the embodiments, and can be arbitrarily modified without departing from the gist of the present technology. That is, any other configurations, manufacturing methods, and the like for carrying out the present technology may be employed.

In the present disclosure, the concepts, which define the shape, the size, the positional relationship, the state, and the like, such as "center", "middle", "uniform", "equal", "the same", "orthogonal", "parallel", "symmetric", "extending", "axis direction", "columnar shape", "cylindrical shape", "ring shape", and "annular shape", are concepts including "substantially center", "substantially middle", "substantially uniform", "substantially equal", "substantially the same", "substantially orthogonal", "substantially parallel", "substantially symmetric", "substantially extending", "substantially the axis direction", "substantially the columnar shape", "substantially the cylindrical shape", "substantially the ring shape", "substantially the annular shape", and the like.

For example, the concepts also include states falling within a predetermined range (e.g., range of ±10%) based on "completely center", "completely middle", "completely uniform", "completely equal", "completely the same", "completely orthogonal", "completely parallel", "completely symmetric", "completely extending", "completely axis direction", "completely columnar shape", "completely cylindrical shape", "completely ring shape", "completely annular shape", and the like.

At least two of the features of the present technology described above can also be combined. In other words, various features described in the respective embodiments may be arbitrarily combined across the respective embodiments. Moreover, the various effects described above are merely illustrative, not limitative, and other effects may be provided.

It should be noted that the present technology can also take the following configurations.

(1) A loudspeaker apparatus, including:
a loudspeaker that outputs sounds; and
a structure configured with respect to an object that is disposed on a sound output side of the loudspeaker and forms, between the object and the loudspeaker, a gap space communicating with an external space, in which
the structure includes
a connecting portion that is connected to the loudspeaker, and
one or more plate-like members that have a plate shape, are disposed in the gap space, extend toward an opening portion of the gap space, and guide sounds output from the loudspeaker toward the external space, the opening portion being located on a side communicating with the external space.

(2) The loudspeaker apparatus according to (1), in which the one or more plate-like members are a plurality of plate-like members and a divided space is formed between the plate-like members adjacent to each other.

(3) The loudspeaker apparatus according to (2), in which the plurality of plate-like members is configured inside the gap space.

(4) The loudspeaker apparatus according to (2), in which at least one of the plurality of plate-like members has an end portion on a side of the opening portion, the end portion protruding outward from the opening portion.

(5) The loudspeaker apparatus according to any one of (2) to (4), in which
the plurality of plate-like members is configured to be parallel to each other.

(6) The loudspeaker apparatus according to any one of (2) to (5), in which
the plurality of plate-like members is configured such that the divided space is opened in a direction orthogonal to an extending direction toward the opening portion.

(7) The loudspeaker apparatus according to any one of (2) to (6), in which
the plurality of plate-like members includes a first member that is disposed at a position furthest from the loudspeaker in a sound output direction, and
the first member has an end portion on a side of the loudspeaker, the end portion being coupled to the connecting portion.

(8) The loudspeaker apparatus according to (7), in which the loudspeaker includes a diaphragm, and
the first member is configured to cover and hide the diaphragm in a region from a position of the connecting portion to an end portion of the first member as viewed from the sound output side of the loudspeaker, the end portion being located on a side of the opening portion.

(9) The loudspeaker apparatus according to (8), in which the plurality of plate-like members includes the first member and one or more second members other than the first member, and
the one or more second members are disposed such that a clearance is formed between an end portion of each second member on the side of the loudspeaker and the connecting portion.

(10) The loudspeaker apparatus according to any one of (2) to (9), in which
the plurality of plate-like members is connected to each other through a reinforcing rib.

(11) The loudspeaker apparatus according to any one of (1) to (10), in which
the loudspeaker includes a diaphragm and a frame disposed around the diaphragm, and
the connecting portion is connected to the frame.

(12) The loudspeaker apparatus according to (11), in which
the connecting portion is held in contact with a portion of the frame, the portion being located on a side opposite to a side of the opening portion of the gap space.

(13) The loudspeaker apparatus according to any one of (1) to (12), in which
the one or more plate-like members are configured integrally with the connecting portion.

(14) The loudspeaker apparatus according to any one of (1) to (13), in which
the loudspeaker includes a diaphragm,
the object is disposed to cover and hide a part of the diaphragm as the object and the loudspeaker are viewed from the sound output side of the loudspeaker, and
the one or more plate-like members guide sounds output from the loudspeaker toward a visible part of the diaphragm.

(15) The loudspeaker apparatus according to any one of (1) to (14), in which
the loudspeaker includes a diaphragm, and
the opening portion of the gap space is configured at a position of an end portion of the object, which is located on a side of the visible part of the diaphragm, as the object and the loudspeaker are viewed from the sound output side of the loudspeaker.

(16) The loudspeaker apparatus according to any one of (1) to (15), in which
the loudspeaker apparatus is incorporated in an electronic apparatus,
the sound output side of the loudspeaker is made to face a front side of the electronic apparatus, and
the object is disposed on the sound output side of the loudspeaker in a state in which the loudspeaker apparatus is incorporated in the electronic apparatus.

(17) The loudspeaker apparatus according to any one of (1) to (16), further including the object.

(18) The loudspeaker apparatus according to any one of (1) to (16), in which the object is a part of the electronic apparatus.

(19) A loudspeaker, including:

a loudspeaker portion that outputs sounds;

a structure configured with respect to an object that is disposed on a sound output side of the loudspeaker portion and forms, between the object and the loudspeaker portion, a gap space communicating with an external space, wherein the structure includes a connecting portion that is connected to the loudspeaker portion, and one or more plate-like members that have a plate shape, are disposed in the gap space, extend toward an opening portion of the gap space, and guide sounds output from the loudspeaker portion toward the external space, the opening portion being located on a side communicating with the external space.

(20) A structure configured with respect to an object that is disposed on a sound output side of a loudspeaker and forms, between the object and the loudspeaker, a gap space communicating with an external space, including:

a connecting portion that is connected to the loudspeaker; and one or more plate-like members that have a plate shape, are disposed in the gap space, extend toward an opening portion of the gap space, and guide sounds output from the loudspeaker toward the external space, the opening portion being located on a side communicating with the external space.

REFERENCE SIGNS LIST

S2 external space
S4 gap space
S6 divided space
P1 opening portion
1 television
4, 4*a* to 4*d* loudspeaker box
7 loudspeaker
7*a* tweeter
19 reflector
20, 220, 320 partition structure
25 diaphragm
26 holding member
27 frame
29 connecting portion
30 to 32, 230 to 234, 330 to 334 plate-like member
30*a*, 31*a*, 32*a*, 231*a* to 233*a*, 332*a* end portion of plate-like member, which is on opening portion side
30*b*, 31*b*, 32*b* end portion of plate-like member, which is on loudspeaker side

The invention claimed is:

1. A loudspeaker apparatus, comprising:

a loudspeaker configured to output a plurality of sounds; and a structure configured with respect to an object that reflects the plurality of sounds and forms a gap space that is in communication with an external space, wherein the object is on a sound output side of the loudspeaker, the gap space is between the object and the loudspeaker, and the structure includes:

a connecting portion that is connected to the loudspeaker, and at least one plate-like member that has a plate shape, wherein the at least one plate-like member is in the gap space and extends toward an opening portion of the gap space, the at least one plate-like member is configured to guide the plurality of sounds towards the external space, and the opening portion is on a side that is in communication with the external space.

2. The loudspeaker apparatus according to claim 1, wherein the at least one plate-like member corresponds to plurality of plate-like members, and a divided space is between the plurality of plate-like members adjacent to each other.

3. The loudspeaker apparatus according to claim 2, wherein the plurality of plate-like members is in the gap space.

4. The loudspeaker apparatus according to claim 2, wherein at least one of the plurality of plate-like members has an end portion on a side of the opening portion, and the end portion protrudes outward from the opening portion.

5. The loudspeaker apparatus according to claim 2, wherein the plurality of plate-like members is configured to be parallel to each other.

6. The loudspeaker apparatus according to claim 2, wherein the divided space is opened in a specific direction, and the specific direction is orthogonal to direction that extends toward the opening portion.

7. The loudspeaker apparatus according to claim 2, wherein the plurality of plate-like members includes a first member that is at a position furthest from the loudspeaker in a sound output direction, the first member has a first end portion on a side of the loudspeaker, and the first end portion is coupled to the connecting portion.

8. The loudspeaker apparatus according to claim 7, wherein the loudspeaker includes a diaphragm, the first member is configured to cover and hide the diaphragm in a specific region, the specific region is from a position of the connecting portion to a second end portion of the first member based on a view from the sound output side of the loudspeaker, and the second end portion is on a side of the opening portion.

9. The loudspeaker apparatus according to claim 8, wherein the plurality of plate-like members includes the first member and at least one second member different from the first member, the at least one second member is configured such that a clearance is between an end portion of each second member, and the end portion of each second member is on the side of the loudspeaker and the connecting portion.

10. The loudspeaker apparatus according to claim 2, wherein the plurality of plate-like members is connected to each other through a reinforcing rib.

11. The loudspeaker apparatus according to claim 1, wherein the loudspeaker includes:

a diaphragm, and a frame around the diaphragm, and the connecting portion is connected to the frame.

12. The loudspeaker apparatus according to claim 11, wherein the connecting portion is in contact with a portion of the frame, and the portion of the frame is on a side opposite to a side of the opening portion of the gap space.

13. The loudspeaker apparatus according to claim 1, wherein the at least one plate-like member is configured integrally with the connecting portion.

14. The loudspeaker apparatus according to claim 1, wherein the loudspeaker includes a diaphragm, the object to covers and hides a part of the diaphragm as the object and the loudspeaker are viewed from the sound output side of the loudspeaker, and the at least one plate-like member guides the plurality of sounds toward a visible part of the diaphragm.

15. The loudspeaker apparatus according to claim 1, wherein the loudspeaker includes a diaphragm, the opening portion of the gap space is at a position of an end portion of the object, and the end portion of the object is located on a side of a visible part of the diaphragm, as the object and the loudspeaker are viewed from the sound output side of the loudspeaker.

16. The loudspeaker apparatus according to claim 1, wherein the loudspeaker apparatus is in an electronic apparatus, the sound output side of the loudspeaker faces a front side of the electronic apparatus, and the object is on the sound output side of the loudspeaker in a state in which the loudspeaker apparatus is in the electronic apparatus.

17. The loudspeaker apparatus according to claim 1, wherein the object is a part of the loudspeaker apparatus.

18. The loudspeaker apparatus according to claim 1, wherein the object is a part of an electronic apparatus.

19. A loudspeaker, comprising:

a loudspeaker portion configured to output a plurality of sounds; and a structure configured with respect to an object that reflects the plurality of sounds and forms a gap space that is in communication with an external space, wherein the object is on a sound output side of the loudspeaker portion, the gap space is between the object and the loudspeaker portion, and the structure includes:

a connecting portion that is connected to the loudspeaker portion, and at least one plate-like member that has a plate shape, wherein the at least one plate-like member is in the gap space and extends toward an opening portion of the gap space, the at least one plate-like member is configured to guide the plurality of sounds toward the external space, and the opening portion is on a side that is in communication with the external space.

20. A structure, comprising:

a connecting portion that is connected to a loudspeaker, wherein the structure is configured with respect to an object that reflects a plurality of sounds and forms a gap space that is in communication with an external space, the loudspeaker outputs the plurality of sounds; and at least one plate-like member that has a plate shape, wherein the at least one plate-like member is in the gap space and extends toward an opening portion of the gap space, the at least one plate-like member is configured to guide the plurality of sounds towards the external space, and the opening portion is on a side communicating that is in communication with the external space.

* * * * *